US008795938B2

(12) United States Patent
Uchinokura et al.

(10) Patent No.: US 8,795,938 B2
(45) Date of Patent: Aug. 5, 2014

(54) TONER AND IMAGE FORMING APPARATUS

(71) Applicants: Osamu Uchinokura, Shizuoka (JP); Tomoyuki Satoh, Kanagawa (JP); Takahiro Honda, Shizuoka (JP); Daisuke Inoue, Shizuoka (JP); Mamoru Hozumi, Miyagi (JP)

(72) Inventors: Osamu Uchinokura, Shizuoka (JP); Tomoyuki Satoh, Kanagawa (JP); Takahiro Honda, Shizuoka (JP); Daisuke Inoue, Shizuoka (JP); Mamoru Hozumi, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/743,528

(22) Filed: Jan. 17, 2013

(65) Prior Publication Data

US 2013/0196261 A1 Aug. 1, 2013

(30) Foreign Application Priority Data

Jan. 30, 2012 (JP) ..... 2012-016688

(51) Int. Cl.
*G03G 9/08* (2006.01)
*G03G 15/08* (2006.01)
*G03G 9/097* (2006.01)

(52) U.S. Cl.
CPC ..... *G03G 9/08* (2013.01); *G03G 15/08* (2013.01); *G03G 9/0806* (2013.01); *G03G 9/09716* (2013.01); *G03G 9/09725* (2013.01); *G03G 9/09791* (2013.01)
USPC ..... 430/108.3; 430/108.7; 430/110.1

(58) Field of Classification Search
CPC ..... G03G 9/09791; G03G 9/09725
USPC ..... 430/108.3, 108.7, 110.1
See application file for complete search history.

(56) References Cited

U.S. PATENT DOCUMENTS

| | | | | |
|---|---|---|---|---|
| 2006/0204877 | A1* | 9/2006 | Kuroyama | 430/108.6 |
| 2006/0222986 | A1* | 10/2006 | Veregin et al. | 430/108.3 |
| 2006/0251978 | A1* | 11/2006 | Pickering | 430/108.4 |
| 2009/0214966 | A1 | 8/2009 | Kishida | |
| 2010/0330482 | A1* | 12/2010 | Okita et al. | 430/105 |
| 2010/0330488 | A1* | 12/2010 | Ieda | 430/108.4 |
| 2011/0053073 | A1* | 3/2011 | Isono et al. | 430/108.3 |
| 2011/0076607 | A1 | 3/2011 | Sugimoto et al. | |
| 2011/0086305 | A1 | 4/2011 | Watanabe et al. | |
| 2011/0129773 | A1 | 6/2011 | Shu et al. | |
| 2011/0151372 | A1 | 6/2011 | Watanabe et al. | |
| 2011/0200928 | A1 | 8/2011 | Watanabe et al. | |
| 2011/0200929 | A1 | 8/2011 | Karato et al. | |
| 2011/0223532 | A1 | 9/2011 | Sugimoto et al. | |
| 2011/0262853 | A1 | 10/2011 | Watanabe et al. | |
| 2011/0294058 | A1 | 12/2011 | Shiba et al. | |
| 2011/0305986 | A1 | 12/2011 | Ogawa et al. | |
| 2011/0318053 | A1 | 12/2011 | Yamashita et al. | |
| 2012/0021347 | A1 | 1/2012 | Shimota et al. | |
| 2012/0052431 | A1 | 3/2012 | Hozumi et al. | |
| 2012/0052434 | A1 | 3/2012 | Sugimoto et al. | |
| 2012/0064447 | A1 | 3/2012 | Hozumi et al. | |
| 2012/0122027 | A1 | 5/2012 | Watanabe et al. | |
| 2012/0219896 | A1 | 8/2012 | Asahina et al. | |
| 2012/0237869 | A1 | 9/2012 | Chiba et al. | |
| 2012/0237870 | A1 | 9/2012 | Watanabe et al. | |
| 2012/0264043 | A1 | 10/2012 | Watanabe et al. | |

FOREIGN PATENT DOCUMENTS

| | | |
|---|---|---|
| EP | 1220043 A2 * | 7/2002 |
| JP | 60-198556 | 10/1985 |
| JP | 61-231562 | 10/1986 |
| JP | 61-231563 | 10/1986 |
| JP | 2001-022118 | 1/2001 |
| JP | 2004-125936 | 4/2004 |
| JP | 2006-154387 | 6/2006 |
| JP | 2007-057787 | 3/2007 |
| JP | 2009-223284 | 10/2009 |
| JP | 2010-079242 | 4/2010 |
| JP | 2011/008129 | 1/2011 |
| JP | 2011-047988 | 3/2011 |
| JP | 2011-047989 | 3/2011 |

* cited by examiner

*Primary Examiner* — Christopher Rodee
(74) *Attorney, Agent, or Firm* — Oblon, Spivak, McClelland, Maier & Neustadt, L.L.P.

(57) ABSTRACT

To provide a toner, which contains: toner base particles each containing a binder resin and a colorant; and an external additive containing inorganic particles and fatty acid metal salt particles, wherein the inorganic particles contain at least hydrophobic silica particles, wherein a liberation ratio Ya of the hydrophobic silica particles from the toner is 1% by mass to 20% by mass, and wherein a libration ratio Yb of the fatty acid metal salt particles from the toner is 30% by mass to 90% by mass.

9 Claims, 5 Drawing Sheets

TONER AND IMAGE FORMING APPARATUS

BACKGROUND OF THE INVENTION

1. Field of the Invention

The present invention relates to a toner, which is suitably used in electrophotography, electrostatic recording, and electrostatic printing, and also relates to an image forming apparatus using such toner.

2. Description of the Related Art

In recent years, formation of images having long shelf life is possible at high speed and low energy in the field of electrophotographic image formation technology. In addition, competitions in developing a color image forming apparatus that gives high image quality have been severe.

In order to meet the need for high image quality, especially full-color image quality, it has been considered that a size of a toner is reduced to accurately reproduce a latent image. Moreover, there has been an attempt to achieve high image quality by controlling a shape of a toner. As a result of this, reproducibility of dots or fine lines is improved, and a pile height (a thickness of an image layer) can be kept low, and therefore an achievement of higher image quality can be expected. Further, for high speed and low energy consuming image formation, required is a toner having the reduced fixing temperature itself, the reduced fixing temperature of the toner during usage, and high lubricity.

To solve the aforementioned problems, it has been widely studied in a structure and a molecular weight of a binder resin, and characteristics of a releasing agent, but heat resistance of a toner and stress resistance of a toner have a relationship of trading-off. In the case where a toner having small particle diameters is used, non-electrostatic adhesion force between a toner and an electrophotographic photoconductor, or between the toner with the electrophotographic photoconductor and an intermediate transfer member increases, and therefore a problem associated with stress resistance of a toner tends to occur. Regarding cleaning property of a toner, it has been known in the art that adhesion force of the toner increases as the particle size of the toner reduces, which lowers the cleaning property.

As for a method for removing an untransferred toner, there are various cleaning systems, such as cleaning blade, fur brush cleaning, and magnetic brush cleaning, but a method for using a cleaning blade is mainly used. This cleaning system is mainly to bring an elastic blade in contact with a photoconductor with an appropriate pressure, but use of a toner meting the current need of high image quality (small particle size, controlled shape, low temperature fixing) in this system causes that the toner passes through the blade, which results in cleaning failures. Studies have been conducted to increase the contact press of the blade and design an appropriate shape of the contact part to prevent the cleaning failures. By increasing the contact press, friction heat is generating in the cleaning unit. Especially a releasing agent having a low melting point or the like is bleed out from the toner with the influence of the local heat, and therefore the residual toner from transferring causes fusion by the friction heat, which becomes a factor of so-called filming.

As a method for solving the aforementioned problems, disclosed is a toner to which a lubricant component, such as a fatty acid metal salt, is added as an external additive of the toner for improving cleaning property (see Japanese Patent Application Laid-Open (JP-A) Nos. 60-198556, 61-231562, and 61-231563).

Moreover, JP-A No. 2010-79242 discloses a toner in which particle diameters and a libration ratio of fatty acid metal salt particles are defined, and discloses that cleaning property, occurrence of fogging, and reduction of image density can be improved by setting the libration ratio of the fatty acid metal salt particles to the range of 1.0% to 25.0%. In accordance with this method, however, it is difficult to maintain cleaning property of the toner in view of the cleaning property, under the circumstance that there is a strong need for a toner of a long shelf life and for use in high speed printing, and the toner satisfying the low temperature fixing ability has a problem that a problem, such as filming, may occur during usage for a long period.

Moreover, JP-A No. 2006-154387 discloses an image forming apparatus in which a libration rate of an external additive liberated from a surface of a toner for use is 5% to 50%, and a fatty acid metal salt is applied on a photoconductor. In accordance with this method, it is disclosed that uneven abrasion of a photoconductive layer of the photoconductor is prevented and a long service life of the photoconductor is maintained. However, in this method, the libration rate of the external additive is high, and therefore there is a possibility that the librated external additive may damage the photoconductor to thereby cause filming.

Accordingly, there are currently needs for a toner having all of high speed printing, long shelf-life, and low temperature fixing ability that are required for electrophotographic image formation, and an image forming apparatus, which uses such toner, can maintain excellent cleaning ability over a long period, and can stably provide high quality images.

SUMMARY OF THE INVENTION

The present invention aims to provide a toner, which can maintain excellent cleaning ability over a long period, and has all of high speed printing, long shelf-life, and low temperature fixing ability that are required for electrophotographic image formation.

The toner of the present invention, which is the means for solving the aforementioned problem, contains:

toner base particles each containing a binder resin and a colorant; and an external additive containing inorganic particles and fatty acid metal salt particles, wherein the inorganic particles contain at least hydrophobic silica particles, wherein a liberation ratio Ya of the hydrophobic silica particles from the toner is 1% by mass to 20% by mass, and wherein a libration ratio Yb of the fatty acid metal salt particles from the toner is 30% by mass to 90% by mass.

The present invention can solve the aforementioned various problems in the art, achieve the aforementioned object, and provide a toner, which can maintain excellent cleaning ability over a long period, and has all of high speed printing, long shelf-life, and low temperature fixing ability that are required for electrophotographic image formation.

DETAILED DESCRIPTION OF THE INVENTION (Toner)

Figure 1:
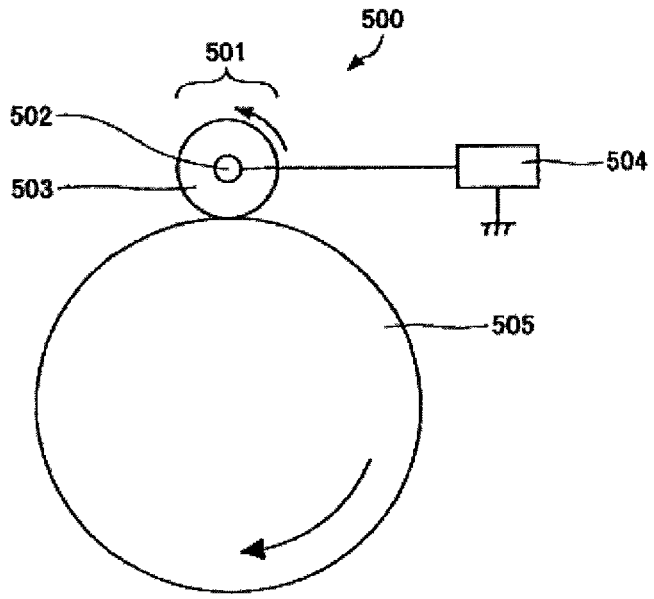
FIG. 1 is a diagram illustrating one example of a roller charging unit used in the image forming apparatus of the present invention.

The toner of the present invention contains toner base particles, and an external additive, and may further contain other components, if necessary.

The present inventors have diligently conducted researches. JP-A No. 2010-79242 discloses that an addition of fatty acid metal salt particles to toner base particles leads to an improvement in cleaning ability of a toner, and discloses in the paragraph [0021] that an occurrence of fogging increases due to libration of the fatty acid metal salt particles, when the libration ratio of the fatty acid metal salt particles is greater than 25.0% by mass. It is suspected that many sites that have opposite charge are present on a toner when fatty acid metal salt particles are strongly deposited onto toner particles to reduce the libration ratio of the fatty acid metal salt particles, which leads to an occurrence of image fogging. However, the present inventors have found that a lubricating effect of the fatty acid metal salt particles can be exhibited at the maximum level without impairing a charging property of the toner, by making the fatty acid metal salt particles easily isolated from the toner base particles, instead of strongly deposited on the toner base particles.

Moreover, it has been found that a toner maintains its cleaning ability over a long period, and satisfies all of high speed, long shelf-life, and low temperature fixing ability, which are required for electrophotographic image formation, when the toner contains toner base particles each containing a binder resin and a colorant, and an external additive containing inorganic particles and fatty acid metal salt particles, wherein the inorganic particles contain at least hydrophobic silica particles, wherein a liberation ratio Ya of the hydrophobic silica particles from the toner is 1% by mass to 20% by mass, and wherein a libration ratio Yb of the fatty acid metal salt particles from the toner is 30% by mass to 90% by mass.

<External Additive>

The external additive contains inorganic particles and fatty acid metal salt particles.

In the present invention, the inorganic particles contain at least hydrophobic silica particles, and a libration ratio Ya of the hydrophobic silica particles from the toner is 1% by mass to 20% by mass, preferably 2% by mass to 10% by mass.

The hydrophobic silica particles are externally added to the toner base particles to attain mainly charging ability and flowability of the toner. The libration of the hydrophobic silica particles from the toner gives adverse effects, such as an occurrence of fogging, and the librated hydrophobic silica particles also damage a surface of a photoconductor, which causes filming. Therefore, it is necessary to prevent the libration of the hydrophobic silica particles as much as possible. In view of the flowability of the toner, however, the libration ratio Ya of the hydrophobic silica particles does not need to be 0 (zero) % by mass, and it is acceptable as long as the libration ratio Ya is 1% by mass or greater. On the other hand, when the libration ratio Ya of the hydrophobic silica particles is greater than 20% by mass, the liberation ratio is too high, and therefore the librated hydrophobic silica particle external additive may damage the photoconductor to cause filming. Therefore, the libration ratio Ya of the hydrophobic silica particles needs to be 20% by mass or less.

The liberation ratio Yb of the fatty acid metal salt particles from the toner is 30% by mass to 90% by mass, preferably 45% by mass to 70% by mass. When the liberation ratio Yb is less than 30% by mass, an effect on the cleaning property is not exhibited, and also fogging of an image may be caused. When the libration ratio Yb is greater than 90% by mass, the fatty acid metal salt particles may be unevenly present in the toner, and therefore lubricity may not be evenly maintained.

Here, the libration ratio Ya of the hydrophobic silica particles and the libration ratio Yb of the fatty acid metal salt particles can be measured, for example, in the following manner.

(1) A 200 mL-ointment bottle is charged with 100 mL of ion-exchanged water, and 4.4 mL of a 33% by mass DRIWEL aqueous solution (product name: DRIWEL, of FUJIFILM Corporation), which contains a surfactant. To the resulting mixture, 5 g of the toner is added, and the mixture is shaken 30 times by hand to sufficiently mix, followed by leaving to stand for 1 hour or longer.

(2) Next, after stirring by shaking 20 times by hand, the resultant is subjected to dispersion by applying ultrasonic wave energy for 2 minutes under the following conditions, by means of a ultrasonic homogenizer (product name: Homogenizer, type VCX750, CV33, Sonics & Materials, Inc.) with setting the dial to output 50%.

—Conditions of Ultrasonic Waves— vibration time: continuous 60 seconds amplitude: 20 W (30%)

vibration onset temperature: 23° C.±1.5° C.

(3) The obtained dispersion liquid is subjected to vacuum filtration using filter paper (product name: Qualitative filter paper (No. 2, 110 mm), of Advantec Tokyo Roshi Kaisha, Ltd.), the resultant is washed twice with ion-exchanged water, and again filtered to remove the librated external additive, followed by drying the toner.

(4) The amount of the external additive contained in the toner before and after the removal of the external additive was determined by calculating the amount (% by mass) from the intensity (or difference in the intensity between before and after the removal of the external additive) of the analytical curve by means of a fluorescent X-ray analyzer (ZSX-100e, of Rigaku Corporation).

In the fluorescent X-ray method, the libration amount of the hydrophobic silica particles is measured by Si, and the libration amount of the fatty acid metal salt particles is measured by the corresponding metal (e.g., zinc, and calcium).

From the values of the external additive amounts contained in the toner before and after the dispersion measured by the method containing (1) to (4), the libration ratio (% by mass) of the external additive can be obtained using the following equation 1.

$$\text{Liberation ratio}=[(\text{external additive amount before dispersion}-\text{residual external additive amount after dispersion})/\text{external additive amount before dispersion}]\times 100 \quad \text{[Equation 1]}$$

When either the libration ratio Ya of the hydrophobic silica particles or the libration ratio Yb of the fatty acid metal salt particles is outside the aforementioned numerical range, a stable image forming process cannot be attained. By satisfying both the liberation ratio Ya and the liberation ratio Yb, a toner having all of high speed printability, long shelf-life and low temperature fixing ability is attained, and use of such toner in image formation can maintain a cleaning property over a long period, and images can be stably obtained.

A method for adjusting the libration ratio Ya of the hydrophobic silica particles and the libration ratio Yb of the fatty acid metal salt particles in the aforementioned numerical range is appropriately selected depending on the intended purpose without any limitation, and examples thereof include a method for adjusting the formulation or type of the hydrophobic silica particles, and a method for adjusting a condition for mixing the external additive. Among them, the method for adjusting a condition for mixing the external additive is particularly preferable.

As for the mixing condition of the external additive, the intended value can be attained by adjusting the order for adding inorganic particles and fatty acid metal salt particles as they are mixed, or rotation number of a high speed flow mixer, or mixing time, or temperature of the raw material bed.

Specific examples thereof include a method in which, after mixing the toner base particles and the inorganic particles, the fatty acid metal salt particles are added to thereby loosely adhere the fatty acid metal salt particles to the toner base particles to which the inorganic particles have been adhered.

If the inorganic particles and the fatty acid metal salt particles are added at the same time, the libration ratio of the inorganic particles may increase or reversely charged sites are present because the fatty acid metal salt particle may present closer to the toner base particle than the inorganic particle. Therefore, functions of each of the inorganic particles and the fatty acid metal salt particles can be sufficiently exhibited by adhering the inorganic particles to the toner base particles, followed by adhering the fatty acid metal salt particles during the mixing.

The mixing of the fatty acid metal salt particles is sufficient as long as it is homogenously mixed and the libration ratio Yb falls within an intended numeral range. Since the fatty acid metal salt particles are not necessarily strongly adhered, the rotation number of the high speed flow mixer and the mixing time are preferably less and shorter than those of the inorganic particles.

Accordingly, as for the method for adjusting the libration ratio Ya of the hydrophobic silica particles and the libration ratio Yb of the fatty acid metal salt particles to the aforementioned numeral range, preferred is (1) after external adding the inorganic particles to the toner base particles, externally adding the fatty acid metal salt particles to the toner base particles.

Moreover, preferred is (2) varying the adhesion state of the external additive by varying the various conditions, such as rotation number of a high speed flow mixer, mixing time and temperature at the time when the inorganic particles are externally added to the toner base particles.

Examples of the high speed flow mixer include HENSCHEL MIXER (HENSCHEL 20B, manufactured by Mitsui Mining Co., Ltd.), and Super Mixer (SMV-20A, manufactured by KAWATA MFG Co., Ltd.).

<<Inorganic Particles>>

The inorganic particles are used as an external additive for imparting a flowability, developing property and charging property to the toner.

The inorganic particles are appropriately selected depending on the intended purpose without any limitation, and examples thereof include particles such as silica, alumina, titanium oxide, barium titanate, magnesium titanate, calcium titanate, strontium titanate, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. These may be used alone, or in combination. Among them, silica particles and titanium oxide particles are preferable, and silica particles and titanium oxide particles, each of which has two or more types of particles having different average primary particle diameters, are particularly preferable.

The average primary particle diameter of the inorganic particles is appropriately selected depending on the intended purpose without any limitation, but it is preferably 5 nm to 2 μm, more preferably 5 nm to 500 nm.

The measurement of the average primary particle diameter of the inorganic particles is performed, for example, by dispersing primary particles in a solvent (tetrahydrofuran (THF)), removing the solvent on a substrate to dry and prepare a sample, and measuring the average value of particle diameters of the external additive (the number of the particles measured: 100 particles) in the visual field as observed under a field emission scanning electron microscope (FE-SEM, accelerating voltage: 5 kV to 8 kV, magnification: ×8,000 to ×10,000).

The inorganic particles are preferably subjected a surface treatment with a flow improving agent. By performing the surface treatment, hydrophobicity of the inorganic particles increases, to thereby prevent degradations of flowability and charging properties of the toner in high humidity environments.

Examples of the flow improving agent include a silane coupling agent, a sililation agent, a silane-coupling agent containing a fluoroalkyl group, an organic titanate-based coupling agent, an aluminum-based coupling agent, silicone oil, and modified-silicone oil.

It is particularly preferred that the silica or titanium oxide, which is the inorganic particles, be used as hydrophobic silica or hydrophobic titanium oxide treated with the aforementioned flow improving agent.

The covering rate of the toner with the inorganic particles, i.e., the covering rate with the external additive exclusive of the fatty acid metal salt particles, is appropriately selected depending on the intended purpose without any limitation, but it is preferably 50% to 85%, more preferably 60% to 80%. The cleaning property is maintained by improving the lubricity due to the externally added fatty acid metal salt particles, but other external additives other than the fatty acid metal salt particles need to maintain an appropriate covering rate, as a surface property of the toner needs to be maintained. When the covering rate is less than 50%, influence of the toner base particles increases, which may cause toner deposition. When the covering rate is more than 85%, the external additive covers all most all area of the surface of the toner base particles, which may cause scratches of a photoconductor, and scraping of the photoconductor, and therefore low temperature fixing ability may not be maintained.

Here, the covering rate of the toner with the inorganic particles can be calculated, for example, by the following equation.

$$H=\Sigma(\sqrt{3}\times D\,v\times Pt/(2\pi\cdot da\cdot Pa)\times Ca\times 100)$$

In the equation above, Dv is the volume average particle diameter of the toner base particles, Pt is the true specific gravity of the toner base particles, da is the average primary particle diameter of the external additive, Pa is the true specific gravity of the external additive, and Ca is the amount (%) of the external additive contained in the toner.

Note that, in the case where the external additive is composed of a few types of external additives, the average primary particle diameter da, true specific gravity Pa, and amount Ca of each external additive are determined to calculate the covering rate with each external additive. The thus obtained covering rates are summed up to determined a total covering rate.

The volume average particle diameter of the toner base particles can be measured, for example, by Coulter Multisizer III (manufactured by Bechman Coulter, Inc.).

The measurement of the average primary particle diameter of the external additive is as described above.

The true specific gravities of the toner base particles and the external additives are measured in accordance with 5-2-1 of JIS-K-0061:92, using le chatelier flask.

<<Fatty Acid Metal Salt Particles>>

Fatty acid of the fatty acid metal salt particles is appropriately selected depending on the intended purpose without any limitation, and examples thereof include: monovalent saturated fatty acid, such as butyric acid, valeric acid, lauric acid, myristic acid, palmitic acid, stearic acid, and montanic acid; polyvalent saturated fatty acid, such as adipic acid, pimelic acid, suberic acid, azelaic acid, and sebacic acid; monovalent unsaturated fatty acid, such as crotonic acid, and oleic acid; and polyvalent unsaturated fatty acid, such as maleic acid, and citraconic acid. Among them, C5-C8 saturated or unsaturated fatty acid metal salt particles are preferable.

The metal of the fatty acid metal salt particles is appropriately selected depending on the intended purpose without any limitation, and examples thereof include lithium, sodium, potassium, copper, rubidium, silver, zinc, magnesium, calcium, strontium, aluminum, iron, cobalt, nickel, and a mixture thereof.

Among them, the fatty acid is preferably stearic acid and the metal is more preferably zinc, magnesium, calcium, or aluminum. The fatty acid metal salt particles are preferably zinc stearate particles, or calcium stearate particles, particularly preferably zinc stearate particles.

Since the zinc stearate particles have cleaving property and high effect of reducing friction, friction between the cleaning blade and the photoconductor can be effectively reduced, and a coating film thereof can be uniformly formed with a small amount thereof.

The volume average particle diameter of the fatty acid metal salt particles is appropriately selected depending on the intended purpose without any limitation, but it is preferably greater than 0.65 μm but 10 μm or smaller, more preferably 1 μm to 5 μm. When the volume average particle diameter is 0.65 μm or smaller, the effect of reducing friction may be weak even when the fatty acid metal salt particles are librated from the toner base particles, because the particle diameters of the fatty acid metal salt particles are small. When the volume average particle diameter thereof is grater than 10 μm, the volume average particle diameter is greater than the volume average particle diameter of the toner, and therefore image defects tend to be caused due to coarse particles.

Here, the volume average particle diameter of the fatty acid metal salt particles can be measured, for example, by a laser diffraction/scattering particle size distribution analyzer (LA-920, manufactured by HORIBA, Ltd.).

An amount of the fatty acid metal salt particles is appropriately selected depending on the intended purpose without any limitation, but the amount thereof is preferably 0.05 parts by mass to 0.4 parts by mass, relative to 100 parts by mass of the toner base particles. When the amount thereof is less than 0.05 parts by mass, a friction reducing effect of the fatty acid metal salt particles may not be obtained. The amount thereof being greater than 0.4 parts by mass is not preferable, as side effect associated with charging property and flowability of the toner may be caused.

<Toner Base Particles>

The toner base particles each contain at least a binder resin and a colorant, and may further contain other components, if necessary.

The binder resin contains a non-crystalline resin and a crystalline resin.

<<Non-Crystalline Resin>>

The non-crystalline resin is preferably a non-crystalline polyester resin in view of low temperature fixing ability and improved glossiness as used in a full-color image forming apparatus.

The non-crystalline polyester resin preferably contains a polyester resin that has not been modified (unmodified polyester resin), and a modified polyester resin.

—Unmodified Polyester Resin—

The unmodified polyester resin is appropriately selected depending on the intended purpose without any limitation, but it is preferably an unmodified polyester resin composed of 45 mol % to 55 mol % of an alcohol component, and 45 mol % to 55 mol % of an acid component.

Examples of the alcohol component include diol, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and a bisphenol derivative (e.g., a bisphenol A ethylene oxide adduct, and bisphenol A propylene oxide).

The acid component is appropriately selected depending on the intended purpose without any limitation, but it is preferably an acid component containing 50 mol % or more of bivalent carboxylic acid relative to the total acid component. Examples of the bivalent carboxylic acid include: benzene carboxylic acid and anhydride thereof, such as phthalic acid, terephthalic acid, isophthalic acid, and phthalic acid anhydride; alkyl dicarboxylic acid and anhydride thereof, such as succinic acid, adipic acid, sebacic acid, and azelaic acid; C6-C18 alkyl group or alkenyl group-substituted succinic acid and anhydride thereof; and unsaturated dicarboxylic acid and anhydride thereof, such as fumaric acid, maleic acid, citraconic acid, and itaconic acid.

Among them, the alcohol component is preferably the bisphenol derivative, and the acid component is preferably phthalic acid, terephthalic acid, isophthalic acid and anhydride thereof succinic acid, N-dodecenyl succinic acid, and anhydride thereof; and dicarboxylic acid such as fumaric acid, maleic acid, and maleic anhydride.

The weight average molecular weight (Mw) of the unmodified polyester resin as measured by gel permeation chromatography (GPC) of a tetrahydrofuran (THF) soluble component thereof is appropriately selected depending on the intended purpose without any limitation, but it is preferably 1,000 to 20,000, more preferably 2,000 to 10,000.

The number average molecular weight (Mn) of the unmodified polyester resin as measured by gel permeation chromatography (GPC) of a tetrahydrofuran (THF) soluble component thereof is appropriately selected depending on the intended purpose without any limitation, and it is, for example, preferably 500 to 6,000, more preferably 1,000 to 5,000.

The ratio (Mw/Mn) of the weight average molecular weight Mw of the unmodified polyester resin to the number average molecular weight Mn of the unmodified polyester resin is preferably 4 or less, more preferably 2 to 4. When the ratio Mw/Mn is more than 4, the elasticity of a resulting toner during fixing becomes large, which may impair low temperature fixing ability. When the ratio Mw/Mn is less than 2, heat resistant storage stability of a resulting toner may be impaired, and recovery of the elasticity thereof is insufficient when receiving the exhaust heat from a sheet, which may cause insufficient anti-sticking of the toner to the ejected sheet.

The glass transition temperature of the unmodified polyester resin is appropriately selected depending on the intended purpose without any limitation, but it is preferably 30° C. to 60° C.

The glass transition temperature of the unmodified polyester resin can be measured from a DSC curve obtained by differential scanning calorimetry (DSC).

The acid value of the unmodified polyester resin is appropriately selected depending on the intended purpose without any limitation, but it is preferably 1 mgKOH/g to 50 mgKOH/g.

The acid value can be measured in accordance with the measuring method described in JIS K0070-1992.

—Modified Polyester Resin—

Use of the modified polyester resin can provide an appropriate degree of a crosslink structure to a resulting toner. The modified polyester resin is appropriately selected depending on the intended purpose without any limitation, provided that it is a resin containing at least either of a urethane bond or a urea bond. The modified polyester resin is preferably a resin obtained through an elongation reaction and/or a crosslink reaction of an active hydrogen group-containing compound with a binder resin precursor (may be referred to as "prepolymer" hereinafter) having a functional group reactive with the active hydrogen group-containing compound.

The prepolymer is appropriately selected depending on the intended purpose without any limitation, provided that it is a polyester resin containing at least a functional group reactive with the active hydrogen group-containing compound.

The functional group reactive with the active hydrogen group contained in the prepolymer is appropriately selected from conventional substituents without any limitation, and examples thereof include an isocyanate group, an epoxy group, carboxylic acid, and an acid chloride group. These may be contained alone or in combination. Among them, the isocyanate group is preferable.

A method for synthesizing the prepolymer is appropriately selected depending on the intended purpose without any limitation. For example, in the case of an isocyanate group-containing prepolymer, the method thereof is a synthesis method containing: heating polyol and polycarboxylic acid at 150° C. to 280° C. in the presence of a conventional esterification catalyst (e.g., titanium tetrabutoxide, dibutyl tin oxide), optionally appropriately reducing the pressure, to generate a reaction product; removing water to obtain hydroxyl group-containing polyester; and reacting the hydroxyl group-containing polyester with polyisocyanate at 40° C. to 140° C. to thereby synthesize an isocyanate group-containing prepolymer.

The polyol is appropriately selected depending on the intended purpose without any limitation, and examples thereof include: diol, such as alkylene glycol (e.g., ethylene glycol, 1,2-propylene glycol, 1,3-propylene glycol, 1,4-butanediol, and 1,6-hexanediol), alkylene ether glycol (e.g., diethylene glycol, triethylene glycol, dipropylene glycol, polyethylene glycol, polypropylene glycol, and polytetramethylene ether glycol), alicyclic diol (e.g., 1,4-cyclohexane dimethanol, and hydrogenated bisphenol A), bisphenol (e.g., bisphenol A, bisphenol F, and bisphenol S), an alkylene oxide (e.g., ethylene oxide, propylene oxide, and butylene oxide) adduct of the alicyclic diol, an alkylene oxide (e.g., ethylene oxide, propylene oxide, and butylene oxide) adduct of the bisphenol; trihydric or higher polyol, such as polyhydric aliphatic alcohol (e.g., glycerin, trimethylol ethane, trimethylol propane, pentaerythritol, and sorbitol), trihydric or higher phenol (e.g., phenol novolak, and cresol novolak), and an alkylene oxide adduct of the trihydric or higher polyphenol; and a mixture of diol and trihydric or higher polyol. These may be used alone, or in combination.

Among them, preferred are the diol alone, or a mixture of the diol and a small amount of the trihydric or higher polyol. The diol is preferably C2-C12 alkylene glycol, and an alkylene oxide adduct of bisphenol (e.g., a bisphenol A ethylene oxide (2 mol) adduct, a bisphenol A propylene oxide (2 mol) adduct, and a bisphenol A propylene oxide (3 mol) adduct).

The polycarboxylic acid is appropriately selected depending on the intended purpose without any limitation, and examples thereof include: alkylene dicarboxylic acid (e.g., succinic acid, adipic acid, and sebacic acid); alkenylene dicarboxylic acid (e.g., maleic acid, and fumaric acid); aromatic dicarboxylic acid (e.g., terephthalic acid, isophthalic acid, and naphthalene dicarboxylic acid); trivalent or higher polycarboxylic acid (e.g., C9-C20 aromatic polycarboxylic acid, such as trimellitic acid, and pyromellitic acid). These may be used alone, or in combination.

Among them, the polycarboxylic acid is preferably C4-C20 alkenylene dicarboxylic acid, and C8-C20 aromatic dicarboxylic acid.

Note that, instead of the polycarboxylic acid, anhydride or lower alkyl ester (e.g., methyl ester, ethyl ester, and isopropyl ester) of the polycarboxylic acid may be used.

A blending ratio of the polyol and the polycarboxylic acid is appropriately selected depending on the intended purpose without any limitation, but it is determined as an equivalent ratio [OH]/[COOH] of hydroxyl groups [OH] of the polyol to carboxyl groups [COOH] of the polycarboxylic acid, which is preferably 2/1 to 1/1, more preferably 1.5/1 to 1/1, and even more preferably 1.3/1 to 1.02/1.

The polyisocyanate is appropriately selected depending on the intended purpose without any limitation, and examples thereof include:

aliphatic polyisocyanate (e.g., tetramethylene diisocyanate, hexamethylene diisocyanate, 2,6-diisocyanato methyl caproate, octamethylene diisocyanate, decamethylene diisocyanate, dodecamethylene diisocyanate, tetradecamethylene diisocyanate, trimethylhexane diisocyanate, and tetramethylhexane diisocyanate); alicyclic polyisocyanate (e.g., isophorone diisocyanate, and cyclohexylmethane diisocyanate); aromatic diisocyanate (e.g., tolylene diisocyanate, diphenyl methane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate, and diphenylether-4,4'-diisocyanate); aromatic aliphatic diisocyanate (e.g., α,α,α',α'-tetramethylxylene diisocyanate); isocyanurate (e.g., tris(isocyanatoalkyl)isocyanurate, and tris (isocyanatocycloalkyl)isocyanurate); phenol derivatives thereof, and a block product thereof where the foregoing compounds are blocked with a phenol derivative, oxime, or caprolactam. These may be used alone, or in combination.

A solvent can be optionally used when the polyisocyanate and the polyester containing a hydroxyl group are reacted. The usable solvent is appropriately selected depending on the intended purpose without any limitation, and examples thereof include those inert to isocyanate, such as aromatic solvents (e.g., toluene, and xylene), ketones (e.g., acetone, methyl ethyl ketone, and methyl isobutyl ketone), esters (e.g., ethyl acetate), amides (e.g., dimethyl formamide, and dimethylacetamide), and ethers (e.g., tetrahydrofuran). These may be used alone, or in combination.

A blending ratio of the polyisocyanate and the hydroxyl group-containing polyester is appropriately selected depending on the intended purpose without any limitation, but it is determined as an equivalent ratio [NCO]/[OH] of isocyanate groups [NCO] of the polyisocyanate to hydroxyl groups [OH] of the hydroxyl group-containing polyester, which is preferably 5/1 to 1/1, more preferably 4/1 to 1.2/1, and even more preferably 2.5/1 to 1.5/1. When the equivalent ratio [NCO]/[OH] is greater than 5, a residual polyisocyanate compound may adversely affect electrostatic propensity of a toner.

——Active Hydrogen Group-Containing Compound——

The active hydrogen group-containing compound functions as an elongation agent or crosslink agent during an elongation reaction or crosslink reaction of the prepolymer in an aqueous medium.

The active hydrogen group is appropriately selected depending on the intended purpose without any limitation, and examples thereof include a hydroxyl group (e.g., an alcoholic hydroxyl group, and a phenolic hydroxyl group), an amino group, a carboxyl group, and a mercapto group. These may be contained alone, or in combination.

The active hydrogen group-containing compound is appropriately selected depending on the intended purpose without any limitation, provided that it contains an active hydrogen group. Examples thereof include water. In the case where the prepolymer is an isocyanate group-containing prepolymer described later, amines are preferable as a resin of high molecular weight can be attained.

The amines used as the active hydrogen group-containing compound are appropriately selected depending on the intended purpose without any limitation, and examples thereof include diamine, trivalent or higher polyamine, amino alcohol, amino mercaptan, amino acid, and a compound in which an amino group of any of these amines has been blocked. Examples of the diamine include aromatic diamine (e.g., phenylene diamine, diethyltoluene diamine, and 4,4'-diaminodiphenyl methane); alicyclic diamine (e.g., 4,4'-diamino-3,3'-dimethyldicyclohexyl methane, diamine cyclohexane, and isophorone diamine); and aliphatic diamine (e.g., ethylene diamine, tetramethylene diamine, and hexamethylene diamine). Examples of the trivalent or higher polyamine include diethylene triamine, and triethylene tetramine. Examples of the amino alcohol include ethanol amine, and hydroxyethyl aniline. Examples of the amino mercaptan include aminoethyl mercaptan, and aminopropyl mercaptan. Examples of the amino acid include aminopropionic acid, and aminocaproic acid. Examples of the compound in which an amino group of these amines is blocked include a ketimine compound and oxazoline compound, which are obtained from any of these amines (e.g., the diamine, the trivalent or higher polyamine, the amino alcohol, the amino mercaptan, and the amino acid) and ketones (e.g., acetone, methyl ethyl ketone, and methyl isobutyl ketone). These may be used alone, or in combination.

Among them, particularly preferred as the amines are diamine, and a mixture of diamine and a small amount of trivalent or higher polyamine.

A modified polyester resin is obtained by subjecting the active hydrogen group-containing compound and the prepolymer to an elongation and/or crosslink reaction an aqueous medium.

The elongation and/or crosslink reaction may be terminated with a reaction terminator (e.g., monoamine, such as diethyl amine, dibutyl amine, butyl amine, and lauryl amine; and a compound obtained by blocking monoamine, such as a ketimine compound).

At the time of a synthesis of the modified polyester resin, a blending ratio of the isocyanate group-containing prepolymer, which is the prepolymer, and the amine, which is the active hydrogen group-containing compound, is appropriately selected depending on the intended purpose without any limitation, but it is determined as an equivalent ratio ([NCO]/[NHx]) of the isocyanate groups [NCO] of the isocyanate group-containing prepolymer to amino groups [NHx] of the amine, which is preferably 1/2 to 2/1, more preferably 1/1.5 to 1.5/1, and more preferably 1/1.2 to 1.2/1.

An amount of the modified polyester resin in the toner is appropriately selected depending on the intended purpose without any limitation, but it is preferably 0.1% by mass to 50% by mass.

<<Crystalline Resin>>

The toner of the present invention can improves its low temperature fixing ability, and can improves its anti-stickiness to a sheet, as containing a crystalline resin.

The crystalline resin is a resin whose crystalline structure clasps around a melting point thereof, and whose viscosity sharply reduces. Accordingly, the crystalline resin can impart excellent low temperature fixing ability to a toner, while maintaining heat resistant stability. Moreover, the elasticity of the crystalline resin promptly recovers once heat is released from a sheet, and therefore anti-sticking of a toner to another sheet can be improved.

The crystalline resin is preferably a crystalline polyester resin in view of improved low temperature fixing ability, as well as improved anti-stickiness to a sheet.

The crystallinity and molecular structure of the crystalline polyester resin can be confirmed by NMR spectroscopy, X-ray diffraction spectroscopy, GC/MS, LC/MS, or IR spectroscopy. For example, in the infrared absorption (IR) spectrum, it is preferred to have absorption peaks derived from δCH (out plane bending) of olefin at 965±10 $cm^{-1}$ and 990±10 $cm^{-1}$. In this case, the compound having the absorption is evaluated as crystalline.

The crystalline polyester resin can be synthesized, for example, by a polycondensation reaction between an alcohol component and an acid component.

The alcohol is appropriately selected depending on the intended purpose without any limitation, and suitable examples thereof include a diol compound.

As for the diol compound, for example, a C2-C8 diol compound is preferable and a C2-C6 diol compound is more preferable. Examples of the diol compound include 1,4-butanediol, ethylene glycol, 1,2-propylene glycol, 1,3-propylene glycol, 1,6-hexanediol, neopentyl glycol, 1,4-butenediol, 1,5-pentanediol, and derivatives thereof. These may be used alone, or in combination. Among them, 1,4-butanediol and 1,6-hexanediol are particularly preferable.

An amount of the diol compound is appropriately selected depending on the intended purpose without any limitation, but it is preferably 80 mol % or greater, more preferably 85 mol % to 100 mol % in the alcohol component.

When the amount of the diol compound in the alcohol component is less than 80 mol %, production efficiency may be impaired.

The acid component is appropriately selected depending on the intended purpose without any limitation, and examples thereof include carboxylic acid having a carbon double bond, a dicarboxylic acid compound, and a polyvalent carboxylic acid compound. Among them, the dicarboxylic acid compound is preferable.

As for the dicarboxylic acid compound, for example, a C2-C8 dicarboxylic acid compound is preferable, and a C2-C6 dicarboxylic acid compound is more preferable.

Examples thereof include oxalic acid, malonic acid, maleic acid, fumaric acid, citraconic acid, itaconic acid, glutaconic acid, succinic acid, adipic acid, anhydride of any of these acids, and C1-C3 alkyl ester of these acids. These may be used alone, or in combination. Among them, fumaric acid is particularly preferable.

Amount of the dicarboxylic acid compound for use is appropriately selected depending on the intended purpose without any limitation, but it is preferably 80 mol % or greater, more preferably 85 mol % to 100 mol % in the acid component. When the amount of the dicarboxylic acid compound in the acid component is less than 80 mol %, production efficiency may be impaired.

Examples of the polyvalent carboxylic acid compound include trimellitic acid, pyromellitic acid, anhydride of these acids, and C1-C3 alkyl ester of these acids.

The polycondensation reaction is appropriately selected depending on the intended purpose without any limitation, and for example, the polycondensation reaction can be performed by reacting at 120° C. to 230° C. in an inert gas atmosphere using an esterification catalyst, a polymerization inhibitor, etc.

When the polycondensation reaction is carried out, all of the monomers may be charged at once for the purpose of improving the strength of an obtaining crystalline polyester resin, or a trivalent or higher monomer is added to react after reacting a divalent monomer for the purpose of reducing the amount of the low molecular weight component, or the pressure of the reaction system may be reduced in the second half of the polycondensation reaction for the purpose of accelerating the reaction, or a trihydric or higher polyhydric alcohol, such as glycerin, may be added as the alcohol component and trivalent or higher polyvalent carboxylic acid, such as trimellitic anhydride may be added as the acid component during the polycondensation reaction to thereby a non-linear polyester, for the purpose of controlling crystallinity and softening point of the crystalline polyester resin.

A molecular weight distribution of the crystalline polyester resin is appropriately selected depending on the intended purpose without any limitation. The molecular weight distribution thereof is preferably sharp, and the lower the molecular weight thereof is, more excellent the low temperature fixing ability is, and therefore it is preferable. In a molecular weight distribution chart as obtained by gel permeation chromatography (GPC) of an orthodichlorobenzene soluble component, in which the horizontal axis represents log (M) and the longitudinal axis represents % by mass, the peak position is appropriately selected depending on the intended purpose without any limitation, but it is preferably 3.5 to 4.0, and moreover, a half-width of the peak is preferably 1.5 or less.

The weight average molecular weight (Mw) of the crystalline polyester resin is appropriately selected depending on the intended purpose without any limitation, but it is preferably 1,000 to 30,000, more preferably 1,200 to 20,000, because a large molecular weight thereof may make it difficult to maintain a sharp melt property.

The number average molecular weight (Mn) of the crystalline polyester resin is appropriately selected depending on the intended purpose without any limitation, but it is preferably 500 to 6,000, more preferably 700 to 5,500.

A molecular weight distribution (Mw/Mn), which is represented as a ratio of the weight average molecular weight (Mw) to the number average molecular weight (Mn), is appropriately selected depending on the intended purpose without any limitation, but it is preferably 2 to 8.

When the molecular weight distribution (Mw/Mn) is less than 2, production becomes difficult and costly. When the molecular weight distribution (Mw/Mn) is more than 8, a sharp melting property may be impaired.

A melting point of the crystalline polyester resin is appropriately selected depending on the intended purpose without any limitation, but it is preferably 60° C. to 130° C. When the melting point thereof is lower than 60° C., viscoelasticity of a toner becomes low at low temperature, and therefore heat resistant storage stability of the toner may be impaired. When the melting point thereof is higher than 130° C., an effect of reducing viscoelasticity becomes insufficient, and therefore low temperature fixing ability of a toner may be insufficient.

The melting point of the crystalline polyester resin can be measured, for example, from a DSC curve obtained by differential scanning calorimetry (DSC).

An acid value of the crystalline polyester resin is appropriately selected depending on the intended purpose without any limitation, but it is preferably 5 mgKOH/g or higher, more preferably 10 mgKOH/g or higher. On the other hand, in view of improvement of a hot offset resistance, the acid value is preferably 45 mgKOH/g or lower.

When the acid value is lower than 5 mgKOH/g, affinity between a recording medium (paper) and the binder resin, and intended low temperature fixing ability of a toner may not be attained.

The acid value of the crystalline polyester resin can be measured, for example, by dissolving the crystalline polyester resin in 1,1,1,3,3,3-hexafluoro-2-propanol, and subjected to the resultant to titration.

A hydroxyl value of the crystalline polyester resin is appropriately selected depending on the intended purpose without any limitation, but it is preferably 0 mgKOH/g to 50 mgKOH/g, more preferably 5 mgKOH/g to 50 mgKOH/g.

When the hydroxyl value is higher than 50 mgKOH/g, it may not be able to attain low temperature fixing ability and excellent charging characteristics.

The hydroxyl value of the crystalline polyester resin can be measured, for example, by dissolving the crystalline polyester resin in 1,1,1,3,3,3-hexafluoro-2-propanol, and subjected to the resultant to titration.

An amount of the crystalline polyester resin as the crystalline resin is appropriately selected depending on the intended purpose without any limitation, but it is preferably 0.1 parts by mass to 50 parts by mass, relative to 100 parts by mass of the unmodified polyester resin as the non-crystalline resin.

<Colorant>

The colorant is appropriately selected depending on the intended purpose without any limitation, and examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone.

An amount of the colorant is appropriately selected depending on the intended purpose without any limitation, but it is preferably 1% by mass to 15% by mass, more preferably 3% by mass to 10% by mass, relative to the toner. When the amount thereof is smaller than 1% by mass, tinting power may be insufficient. When the amount thereof is greater than 15% by mass, fixing of a toner may be inhibited.

The colorant may be used as a master batch in which the colorant forms a composite with a resin. Examples of the binder resin kneaded in the production of, or together with the master batch include, other than the aforementioned modified or unmodified polyester resin, polymer of styrene or substitution thereof (e.g., polystyrene, poly-p-chlorostyrene, and polyvinyl); styrene copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer); and others including polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, a terpene resin, an aliphatic or alicyclic hydrocarbon resin, an aromatic petroleum resin, chlorinated paraffin, and paraffin wax. These may be used alone, or in combination.

The master batch can be prepared by mixing and kneading the colorant with the resin for the master batch. In the mixing and kneading, an organic solvent may be used for improving the interactions between the colorant and the resin. Moreover, the master batch can be prepared by a flashing method in which an aqueous paste containing a colorant is mixed and kneaded with a resin and an organic solvent, and then the colorant is transferred to the resin to remove the water and the organic solvent. This method is preferably used because a wet cake of the colorant is used as it is, and it is not necessary to dry the wet cake of the colorant to prepare a colorant. In the mixing and kneading of the colorant and the resin, a high-shearing disperser (e.g., a three-roll mill) is preferably used.

<Other Components>

Other components are appropriately selected depending on the intended purpose without any limitation, and examples thereof include a releasing agent, a charge controlling agent, resin particles, and a magnetic material.

—Releasing Agent—

The releasing agent is appropriately selected depending on the intended purpose without any limitation, and examples thereof include natural wax, such as vegetable wax (e.g. carnauba wax, cotton wax, Japan wax, and rice wax), animal wax (e.g., bees wax and lanolin), mineral wax (e.g., ozokelite and ceresin), and petroleum wax (e.g., paraffin wax, microcrystalline wax and petrolatum). Examples of the wax other than the natural wax listed above include: synthetic hydrocarbon wax (e.g., Fischer-Tropsch wax, polyethylene wax and polypropylene wax); and synthetic wax (e.g., ester wax, ketone wax and ether wax). Further examples include: a fatty acid amide compound, such as 1,2-hydroxystearic acid amide, stearic amide, phthalic anhydride imide and chlorinated hydrocarbons; low-molecular-weight crystalline polymer resins such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain.

As for the releasing agent, any of these may be used alone or in combination. Among them, hydrocarbon wax, such as paraffin, polyethylene, and polypropylene, is preferable. Since the hydrocarbon wax has low compatibility to the fixing aid component for use in the present invention, and therefore the hydrocarbon wax can function independently without impairing the functions of both the hydrocarbon wax and the fixing aid component. As a result, sufficient low temperature fixing ability of a toner can be attained.

An amount of the releasing agent in the toner is appropriately selected depending on the intended purpose without any limitation, but it is preferably 1% by mass to 40% by mass, more preferably 5% by mass to 35% by mass.

—Charge Controlling Agent—

The charge controlling agent is appropriately selected depending on the intended purpose without any limitation, and examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. These may be used alone, or in combination.

As for the charge controlling agent, a commercial product can be used, and examples thereof include: nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all manufactured by ORIENT CHEMICAL INDUSTRIES CO., LTD); quaternary ammonium salt molybdenum complex TP-302 and TP-415 (all manufactured by Hodogaya Chemical Co., Ltd.); LRA-901; quaternary ammonium salt COPY CHARGE PSY VP 2038, triphenylmethane derivative COPY BLUE PR, quaternary ammonium salt COPY CHARGE NEG VP2036 and COPY CHARGE NX VP434 (all manufactured by Hoechst AG) boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

An amount of the charge controlling agent in the toner is not particularly limited, and cannot be determined unconditionally as it may vary depending on a type of the binder resin for use, a presence of additives, and a method for dispersing. For example, the amount of the charge controlling agent is preferably 0.1 parts by mass to 10 parts by mass, more preferably 0.2 parts by mass to 5 parts by mass, relative to 100 parts by mass of the resin component. When the amount thereof is less than 0.1 parts by mass, charge controlling properties may not be provided. When the amount thereof is greater than 10 parts by mass, the electrostatic propensity of the resulting toner is excessively large, and therefore an effect of the charge controlling agent is reduced and electrostatic force to a developing roller increases, which may reduce flowability of the toner, or reduce image density of images formed with the resulting toner.

The charge controlling agent may be added by dissolving and dispersing after melting and kneading together with the master batch or the resin, or added by dissolving or dispersing directly in the organic solvent, or added by fixing on a surface of each toner particle after the preparation of the toner particles.

—Resin Particles—

The resin particles are appropriately selected depending on the intended purpose without any limitation, and examples thereof include a vinyl-based resin, a polyurethane resin, an epoxy resin, a polyester resin, a polyamide resin, a polyimide resin, a silicon-based resin, a phenol resin, a melamine resin, a urea resin, an aniline resin, an iomer resin, and a polycarbonate resin. Among them, the vinyl-based resin, polyurethane resin, epoxy resin, polyester resin, and a combination of any of these are preferable as an aqueous dispersion of fine spherical resin particles is easily obtained, and the vinyl-based resin is more preferable.

The vinyl-based resin is a polymer obtained through homopolymerization or copolymerization of a vinyl-based monomer, and examples thereof include a styrene-(meth) acrylate resin, a styrene-butadiene copolymer, (meth)acrylic acid-acrylic acid ester polymer, a styrene-acrylonitrile copolymer, a styrene-maleic anhydride copolymer, and a styrene-(meth)acrylic acid copolymer. Among them, a styrene-butyl methacrylate copolymer is preferable.

Moreover, as for the resin particles, a copolymer containing a monomer having at least two unsaturated groups may be used.

The monomer having at least two unsaturated groups is appropriately selected depending on the intended purpose without any limitation, and examples thereof include a sodium salt of sulfuric acid ester of methacrylic acid-ethylene oxide adduct (ELEMINOL RS-30, manufactured by Sanyo Chemical Industries, Ltd.), divinyl benzene, and 1,6-hexanediol acrylate.

The glass transition temperature (Tg) of the resin particles is appropriately selected depending on the intended purpose without any limitation, but it is preferably 50° C. to 70° C. When the glass transition temperature (Tg) thereof is lower than 50° C., heat resistant storage stability of a toner becomes poor, which may cause blocking during storage or within a developing unit. When the Tg thereof is higher than 70° C., the resin particles inhibits adhesion of the toner to fixing paper, which may reduce the minimum fixing temperature.

The weight average molecular weight of the resin particles is appropriately selected depending on the intended purpose without any limitation, but it is preferably 9,000 to 200,000. When the weight average molecular weight thereof is smaller than 9,000, heat resistant storage stability of a resulting toner may be low. When the weight average molecular weight thereof is greater than 200,000, a resulting toner may have insufficient low temperature fixing ability.

The average particle diameter of the resin particles is appropriately selected depending on the intended purpose without any limitation, but it is preferably 5 nm to 200 nm, more preferably 20 nm to 150 nm.

An amount of the resin particles is appropriately selected depending on the intended purpose without any limitation, but it is preferably 0.5% by mass to 5.0% by mass. When the amount thereof is less than 0.5% by mass, it may be difficult to control a surface hardness and fixing ability of a toner. When the amount thereof is more than 5.0% by mass, the resin particles inhibit bleeding of the wax, which may cause offset.

—Magnetic Material—

The magnetic material is appropriately selected depending on the intended purpose without any limitation, and examples thereof include iron powder, magnetite, and ferrite. Among them, a white magnetic material is preferable in terms of a color tone.

<Production Method of Toner>

A production method of the toner of the present invention is appropriately selected conventional toner production methods known in the art depending on the intended purpose without any limitation, but the production method thereof contains a toner base particle production step, and an external treatment step, and may further contain other steps, if necessary.

<<Toner Base Particle Production Step>>

The toner base particle production step is producing toner base particles each containing at least a binder resin and a colorant. Examples thereof include a kneading-pulverizing method, a polymerization method, a dissolution suspension method, and a spray granulating method. Among them, the polymerization such as dissolution suspension is particularly preferable because diameters and shapes of particles are easily controlled.

—Pulverization Method—

The pulverization method is a method for producing toner base particles, for example, by melting and kneading a toner material containing at least a binder resin and a colorant, pulverizing the resulting kneaded product, and classifying the pulverized particles. In the melting and kneading (melt-kneading), materials of the toner material are mixed, and the resulting mixture is placed in a melt-kneader to perform melt-kneading. As the melt-kneader, for example, a monoaxial or biaxial continuous kneader, or a batch-type kneader with a roll mill can be used. Preferable examples thereof include a twin screw extruder KTT manufactured by KOBE STEEL, LTD., an extruder TEM manufactured by TOSHIBA MACHINE CO., LTD., a twin screw extruder manufactured by ASADA WORKS CO., LTD., a twin screw extruder PCM manufactured by Ikegai Corp., and a cokneader manufactured by Buss. The melt-kneading is preferably performed under appropriate conditions that do not cause cleaving of molecular chains of the binder resin. Specifically, the melt-kneading temperature is determined with reference to a softening point of the binder resin. When the softening point thereof is too high, molecular chain cleavage is significant. When the softening point thereof is too low, dispersion may not be progressed.

In the pulverizing, the kneaded product obtained by the kneading is pulverized. In the pulverizing, it is preferred that the kneaded product be coarsely pulverized, followed by finely pulverized. For the pulverizing, a method in which the kneaded product is pulverized by making the kneaded product to crush into an impact plate in the jet stream, a method in which particles of the kneaded product are made crushed each other in the jet stream to thereby pulverize the kneaded product, or a method in which the kneaded product is pulverized in a narrow gap between a mechanically rotating rotor and a stator is preferably used.

The classifying is classifying the pulverized product obtained by the pulverizing into particles having the predetermined particle diameters. The classifying can be performed by removing the undesirable fine particle component by a cyclone, a decanter, a centrifugal separator, or the like. After the completion of the pulverizing and the classifying, the classified pulverized product is classified in an air stream by centrifugal force or the like to thereby produce toner base particles having the predetermined particle diameters.

—Polymerization Method—

As for the production method of the toner using the polymerization method, for example, characterized is a method containing: dispersing, in an aqueous medium, a solution and/or dispersion liquid obtained by dissolving and/or dispersing an active hydrogen group-containing compound, a binder resin precursor having a site reactive with the active hydrogen group-containing compound, a binder resin, a colorant, and a releasing agent in an organic solvent, to thereby obtain an emulsified dispersion liquid; allowing the binder resin precursor and the active hydrogen group-containing compound to react in the emulsified dispersion liquid; and removing the organic solvent. Specifically, the polymerization method contains preparation of an oil phase, preparation of an aqueous phase, preparation of a toner dispersion liquid, and removal of a solvent, and may further contain other steps.

——Preparation of Oil Phase——

The preparation of oil phase is appropriately selected depending on the intended purpose without any limitation, provided that it is a step containing dissolving and/or dispersing, in an organic solvent, an active hydrogen group-containing compound, a binder resin precursor having a site reactive with the active hydrogen group-containing compound, a binder resin, a colorant, and a releasing agent to prepare a solution and/or a dispersion liquid.

Examples of a preparation method of the oil phase include a method containing, gradually adding an active hydrogen group-containing compound, a binder resin precursor having a site reactive with the active hydrogen group-containing compound, a binder resin, a colorant, and a releasing agent, and optionally the charge controlling agent in an organic solvent with stirring, to thereby dissolve and/or disperse the contents in the organic solvent.

In the case where a pigment is used as the colorant, or the case where a compound hardly soluble in an organic solvent, such as the charge controlling agent, is added to the organic solvent, it is preferred that particles are made small before added to the organic solvent.

The formation of a master batch of the coloring agent is one of the suitable methods, and the same method can be applied to the ester wax and the charge controlling agent.

As another method, it is also possible to obtain a wet master in the organic solvent by optionally adding a dispersion aid, and dispersing the colorant, the releasing agent, and the charge controlling agent in a wet system.

In the case where a compound which melts at temperature lower than the boiling point of the organic solvent is to be dispersed, as yet another method, usable is a method containing optionally adding a dispersion aid, stirring and heating the dispersoid to dissolve the dispersoid in the organic solvent, cooling the solution with stirring or applying shear force to perform crystallization to thereby generate microcrystal of the dispersoid.

The colorant, the releasing agent, and the optional charge controlling agent as dispersed in the aforementioned manner may be dissolved or dispersed in the organic solvent, together with the active hydrogen group-containing compound, the binder resin precursor having a site reactive with the active hydrogen group-containing compound, and the binder resin, and the resultant may be further dispersed. The dispersing is not particularly limited, and a conventional disperser, such as a bead mill and a disc mill can be used.

Moreover, it is preferred that a toner be produced in the state where the binder resin precursor having the site reactive with the active hydrogen group-containing compound is dissolved in the oil phase, i.e., the oil phase containing the active hydrogen group-containing compound and the binder resin precursor, for the purpose of enhancing mechanical strength of a resulting toner, and preventing hot offset during fixing.

The organic solvent used for the preparation of oil phase is appropriately selected depending on the intended purpose without any limitation, but it is preferably an organic solvent having a boiling point of lower than 100° C., because removal of the organic solvent becomes easy in a later step. Examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used alone, or in combination.

In the case where the binder resin dissolved or dispersed in the organic solvent is a resin having a polyester skeleton, for example, an ester-based solvent (e.g., methyl acetate, ethyl acetate, and butyl acetate) or a ketone solvent (e.g., methyl ethyl ketone, and methyl isobutyl ketone) is preferably used in view of its excellent dissolving ability. Among them, particularly preferred are methyl acetate, ethyl acetate and methyl ethyl ketone having high removability of the solvent.

——Preparation of Aqueous Phase——

The preparation of an aqueous phase is appropriately selected depending on the intended purpose without any limitation, provided that it is a step containing preparing an aqueous phase.

An aqueous medium used for the preparation of an aqueous phase is appropriately selected depending on the intended purpose without any limitation, and examples thereof include water. The aqueous medium may be composed of water alone, or a combination of water and an organic solvent miscible with water. Examples of the organic solvent miscible with water include alcohol (e.g., methanol, isopropanol, and ethylene glycol), dimethyl formamide, tetrahydrofuran, cellosolve (e.g., methyl cellosolve), and lower ketone (e.g., acetone, and methyl ethyl ketone).

The aqueous medium preferably further contains a surfactant.

The surfactant is appropriately selected depending on the intended purpose without any limitation, and examples thereof include: an anionic surfactant, such as an alkyl benzene sulfonic acid salt, an α-olefin sulfonic acid salt, phosphoric acid ester, and a disulfonic acid salt; a cationic acid, such as an amine salt surfactant (e.g., an alkyl amine salt, an amino alcohol fatty acid derivative, a polyamine fatty acid derivative, and imidazoline), and a quaternary ammonium salt surfactant (e.g., an alkyl trimethyl ammonium salt, a dialkyldimethyl ammonium salt, an alkyldimethylbenzyl ammonium salt, a pyridinium salt, an alkyl isoquinolinium salt, and benzethonium chloride); a nonionic surfactant, such as a fatty acid amide derivative, and a polyhydric alcohol derivative; and an amphoteric surfactant, such as alanine, dodecyldi(aminoethyl)glycine, di(octylaminoethyl)glycine, and N-alkyl-N,N-dimethyl ammonium betaine. Among them, disulfonic acid salt having high HLB is preferable for efficiently dispersing oil droplets containing the solvent.

An amount of the surfactant contained in the aqueous medium is appropriately selected depending on the intended purpose without any limitation, but a concentration thereof in the aqueous medium is preferably 3% by mass to 10% by mass, more preferably 4% by mass to 9% by mass, and even more preferably 5% by mass to 8% by mass. When the concentration thereof is lower than 3% by mass, oil droplets may not be stably dispersed and therefore sizes of the oil droplets may become large. When the concentration thereof is higher than 10% by mass, size of oil droplets may become too small, a reverse micelle structure may be formed to reduce dispersion stability, which may cause formation of coarse oil droplets.

——Preparation of Toner Dispersion Liquid——

The preparation of a toner dispersion liquid is appropriately selected depending on the intended purpose without any limitation, provided that it is a step containing dispersing the oil phase in the aqueous phase to prepare an emulsified dispersion liquid (a toner dispersion liquid).

The method of the dispersing is appropriately selected depending on the intended purpose without any limitation, and examples thereof include a method for dispersing using a conventional equipment, such as low speed shearing, high speed shearing, friction, high pressure jet, and ultrasonic dispersers. In order to attain the toner base particles having the particle size of 2 μm to 20 μm, preferable is dispersing using the high speed hearing disperser. In the case where the high speed shear disperser is used, the rotation number thereof is appropriately selected depending on the intended purpose without any limitation, but it is preferably 1,000 rpm to 30,000 rpm, more preferably 5,000 rpm to 20,000 rpm. The dispersion time is appropriately selected depending on the intended purpose without any limitation. In case of the batch system, the dispersion time is preferably 0.1 minutes to 5 minutes. When the dispersion time is longer than 5 minutes, undesirable particles of small diameters may remain, or the dispersion may result in an excess dispersion state, which may unstabilize the system to form aggregations, or generate coarse particles. The temperature during the dispersing is appropriately selected depending on the intended purpose without any limitation, but it is preferably 0° C. to 40° C., more preferably 10° C. to 30° C. When the temperature during the dispersing is lower than 0° C., the viscosity of the dispersing elements increases, and therefore the shearing energy required for dispersing increases, which may lower the production efficiency. When the temperature during the dispersing is higher than 40° C., the molecular motion is accelerated and therefore the dispersion stability is reduced to thereby generate aggregates or coarse particles.

An amount of the organic solvent contained in the toner dispersion liquid is appropriately selected depending on the intended purpose without any limitation, but it is preferably 10% by mass to 70% by mass, more preferably 25% by mass to 60% by mass, and even more preferably 40% by mass to 55% by mass.

Note that, the amount of the organic solvent contained in the toner dispersion liquid is an amount thereof relative to the solid contents (e.g., the binder resin, the colorant, the releasing agent, and the optional charge controlling agent) in the state of the toner dispersion liquid.

——Removal of Solvent——

The removal of a solvent is appropriately selected depending on the intended purpose without any limitation, provided that it is a step containing removing the solvent contained in the toner dispersion liquid, but it is preferably a step for completely removing the organic solvent contained in the toner dispersion liquid. Examples thereof include: a method for completely evaporating and removing the organic solvent contained in droplets by gradually heating the toner dispersion liquid with stirring; a method for completely removing the organic liquid contained in the droplets by spraying the toner dispersion liquid in a dry atmosphere with stirring; and a method for evaporating and removing the organic solvent by reducing the pressure while stirring the toner dispersion liquid. The two latter methods can be used in combination with the first method.

The dry atmosphere to which the toner dispersion liquid is sprayed is appropriately selected depending on the intended purpose without any limitation, and examples thereof include heated gas, such as air, nitrogen, carbon dioxide and combustion gas.

The temperature of the dry atmosphere is appropriately selected depending on the intended purpose without any limitation, but it is preferably the temperature equal to or higher than the boiling point of the solvent having the highest boiling point.

The spraying is performed, for example, by means of a spray dryer, a belt dryer, or a rotary kiln. A treatment of a short period using any of these dryers can sufficiently achieve the intended quality.

——Other Steps——

Other steps are appropriately selected depending on the intended purpose without any limitation, and examples thereof include aging, washing, and drying.

———Aging———

In the case where the oil phase contains the polyester resin (prepolymer) having a functional group reactive with an active hydrogen group of the active hydrogen group-containing compound, aging is preferably carried out to proceed to an elongation and/or crosslink reaction of the prepolymer.

The aging is preferably performed after the removal of a solvent but before the washing.

In the aging, the period for aging is appropriately selected depending on the intended purpose without any limitation, but it is preferably 10 minutes to 40 hours, more preferably 2 hours to 24 hours.

The reaction temperature during the aging is appropriately selected depending on the intended purpose without any limitation, but it is preferably 0° C. to 65° C., more preferably 35° C. to 50° C.

———Washing———

The washing is appropriately selected depending on the intended purpose without any limitation, provided that it is a step performed subsequently to the removal of a solvent or the aging, and containing washing the toner (toner base particles) contained in the toner dispersion liquid.

The toner dispersion liquid contains, other than the toner base particles, secondary materials, such as a dispersant (e.g., a surfactant), and therefore the washing is performed to collect only the toner base particles from the toner dispersion liquid.

A washing method of the toner base particles is appropriately selected depending on the intended purpose without any limitation, and examples thereof include centrifugal separation, vacuum filtration, and filter press. In accordance with any of these methods, a cake of the toner base particles can be obtained. In the case where washing cannot be sufficiently performed with one operation, a series of the operations, which contains dispersing the obtained cake again in an aqueous medium to prepare a slurry, and collecting the toner base particles in accordance with any of the aforementioned method, may be repeated. In the case where the washing is performed by vacuum filtration or filter press, it may employ a method in which the aqueous medium is passed through the cake to wash out the secondary materials included in the toner base particles. As for the aqueous medium used for the washing, used is water, or a mixed solvent prepared by mixing water with alcohol such as methanol and ethanol. However, in view of a cost, and environmental load associated with a waste water processing, use of water is preferable.

———Drying———

The drying is appropriately selected depending on the intended purpose without any limitation, provided that it is a step containing drying the toner base particles after the washing.

The toner base particles washed by the washing contain a lot of moisture, and therefore the drying is performed to remove the particles to thereby obtain only the toner base particles.

A method for removing the moisture from the toner base particles is appropriately selected depending on the intended purpose without any limitation, and examples thereof include a method using a dryer, such as a spray dryer, a vacuum freezing dryer, a vacuum dryer, a stand still shelf dryer, a mobile shelf dryer, a flow tank dryer, a rotary dryer, and a stirring dryer.

It is preferred that the removal of the moisture be performed until the moisture content of the toner base particles becomes less than 1% by mass. Moreover, in the case where the toner base particle after removing the moisture are aggregated softly, which may cause a problem, the toner base particles are subjected to cracking to loosen the soft aggregations by means of a device, such as a jet mill, HENSCHEL MIXER, Super Mixer, a coffee mill, an oster blender, and a food processor.

<<External Additive Treatment>>

The external additive treatment is a step containing externally adding an external additive containing the inorganic particles and the fatty acid metal salt particles to the toner base particles.

A method for externally adding the inorganic particles and the fatty acid metal salt particles to the toner base particles is appropriately selected depending on the intended purpose without any limitation, and examples thereof include a method for externally adding the inorganic particles and the fatty acid metal salt particles using a high speed flow mixer or the like. Note that, the external additive treatment needs to be adjusted so that the libration ratio of the inorganic particles and that of the fatty acid metal salt particles fall in the ranges specified above.

To this end, these additives may be optionally each or in the mixture cracked in advance to remove coarse aggregates, and then externally added to the toner base particles. Alternatively, the toner base particles, inorganic particles, fatty acid metal salt, and other materials may be individually added to the aforementioned device to be mixed, or after the mixing, the external additive may be blended using another device.

In the present invention, in order to adjust the libration ratio Ya of the hydrophobic silica particles and the libration ratio Yb of the fatty acid metal salt particles to the aforementioned numeral range, preferred is (1) after external adding the inorganic particles to the toner base particles, externally adding the fatty acid metal salt particles to the toner base particles.

Moreover, preferred is (2) varying the adhesion state of the external additive by varying the various conditions, such as rotation number of a high speed flow mixer, mixing time and temperature at the time when the inorganic particles are externally added to the toner base particles.

As for the mixing condition of the external additive, the intended value can be achieved by adjusting the order for adding inorganic particles and fatty acid metal salt particles as they are mixed, or rotation number of a high speed flow mixer, or mixing time, or temperature of the raw material bed.

Specific examples thereof include a method in which, after mixing the toner base particles and the inorganic particles, the fatty acid metal salt particles are added to thereby loosely adhere the fatty acid metal salt particles to the toner base particles to which the inorganic particles have been adhered.

If the inorganic particles and the fatty acid metal salt particles are added at the same time, the libration ratio of the inorganic particles may increase or reversely charged sites are present because the fatty acid metal salt particle may present closer to the toner base particle than the inorganic particle. Therefore, functions of each of the inorganic particles and the fatty acid metal salt particles can be sufficiently exhibited by adhering the inorganic particles to the toner base particles, followed by adhering the fatty acid metal salt particles during the mixing.

The mixing of the fatty acid metal salt particles is sufficient as long as it is homogenously mixed and the libration ratio Yb falls within an intended numeral range. Since the fatty acid metal salt particles are not necessarily strongly adhered, the rotation number of the high speed flow mixer and the mixing time are preferably less and shorter than those of the inorganic particles.

The volume average particle diameter Dv of the toner of the present invention is appropriately selected depending on the intended purpose without any limitation, but it is preferably 3.0 μm to 7.0 μm, more preferably 3.5 μm to 6.5 μm. A ratio (Dv/Dn) of the volume average particle diameter to the number average particle diameter is appropriately selected depending on the intended purpose without any limitation, but it is preferably 1.2 or less, more preferably 1.10 to 1.20. Moreover, it is preferred that the toner contain 1% by number to 10% by number of the particle component having the particle diameters of 2 μm or smaller.

When the volume average particle diameter thereof is 3.0 μm or greater, a cleaning property of the toner as remained on a surface of the latent electrostatic image bearing member becomes excellent. When the volume average particle diameter thereof is 7.0 μm or smaller, dot-reproducibility or granularity of printed images becomes excellent and fixing ability also becomes excellent.

As for a measuring device of the particle size distribution of the toner, for example, Coulter Multisizer III (manufactured by Bechman Coulter, Inc.) is used. The measuring method will be described below.

First, 0.1 mL to 5 mL of a surfactant (alkyl benzene sulfonate) is added as a dispersant to 100 mL to 150 mL of an electrolyte. Note that, the electrolyte is an about 1% by mass aqueous solution prepared by using a primary sodium chloride, and for example, ISOTON-II (of Beckman Coulter, Inc.) is used as the electrolyte. Next, to the resulting mixture, 2 mg to 20 mg of a sample is added and suspended, and the mixture is dispersed by means of an ultrasonic wave disperser for about 1 minute to about 3 minutes. The volume and number of the toner particles or toner are measured from the obtained dispersion liquid using the aforementioned measuring device with an aperture of 100 μm, and then the volume distribution and the number distribution of the toner can be calculated.

—Average Circularity—

The average circularity of the toner is appropriately selected depending on the intended purpose without any limitation, but it is preferably 0.93 to 0.99, more preferably 0.94 to 0.98. When the average circularity thereof is 0.93 or higher, primary transfer property from the latent electrostatic image bearing member to transfer paper or an intermediate transfer member, or secondary transfer property from the intermediate transfer member to transfer paper becomes excellent. When the average circularity thereof is 0.99 or lower, the toner attains excellent cleaning properties as remained on a surface of the latent electrostatic image bearing member.

The average circularity of the toner can be measured, for example, in the following manner.

The average circularity of the toner particles is measured using a flow particle image analyzer (FPIA-2100, manufactured Sysmex Corporation), and the measurement results are analyzed using an analysis software (FPIA-2100 Data Processing Program for FPIA version 00-10). Specifically, a 100 mL glass beaker is charged with 0.1 mL to 0.5 mL of a 10% by mass surfactant (Neogen SC-A, manufactured by Dai-Ichi Kogyo Seiyaku Co., Ltd.), and 0.1 g to 0.5 g of each toner, and the mixture is stirred microspartel, followed by adding 80 mL of ion-exchanged water. The obtained dispersion liquid is dispersed for 3 minutes by means of an ultrasonic wave disperser (manufactured by Honda Electronics Co., Ltd.), and the resulting dispersion liquid having a concentration of 5,000 particles/μL to 15,000 particles/μL is subjected to measurement of the shape and distribution of the toner by means of FPIA-2100. In this measuring method, it is important that the concentration of the dispersion liquid is 5,000 particles/4 to 15,000 particles/4 in view of measurement reproducibility of the average circularity. In order to obtain the concentration of the dispersion liquid, it is necessary to adjust the conditions of the dispersion liquid, i.e., an amount of the surfactant added, and an amount of the toner added. Similarly to the measurement of the toner particle diameters described earlier, an amount of the surfactant required is different depending on hydrophobicity of a toner. When the amount of the surfactant is large, noise occurs due to bubbles as formed. When the amount thereof is small, dispersion is insufficient. Moreover, an amount of the toner added is different depending on the particle diameters of the toner. It is necessary that the toner having small particle diameters is added in a small amount, and the toner having large particle diameters is added in a large amount. In the case where the particle diameters of the toner are in the range of 3 μm to 7 μm, it is possible to adjust the concentration of the dispersion liquid to the range of 5,000 particles/μL to 15,000 particles/μL by adding 0.1 g to 0.5 g of the toner.

A color of the toner of the present invention is appropriately selected depending on the intended purpose without any limitation, and it may be at least one selected from the group consisting of a black toner, a cyan toner, a magenta toner, and a yellow toner. The toner of each color can be obtained by appropriately selecting a type of the colorant.

<Developer>

The developer for use in the present invention contains at least the toner, and may further contain a carrier, and other components, if necessary. The developer may be a one-component developer, or two-component developer. In the case where the developer is used for a high speed printer corresponding to recent high information processing speed, the developer is preferably the two-component developer in view of improved service life.

In the case where the developer is used as a one-component developer, the diameters of the toner particles do not vary largely even when the toner is balanced, namely, the toner is supplied to the developer, and consumed by developing, the toner does not cause filming to a developing roller, nor fuse to a layer thickness regulating member such as a blade for thinning a thickness of a layer of the toner, and provides excellent and stable developing ability and image even when it is stirred in the developing unit over a long period of time. In the case where the developer is used as a two-component developer, the diameters of the toner particles in the developer do not vary largely even when the toner is balanced, and the toner can provide excellent and stabile developing ability even when the toner is stirred in the developing unit over a long period of time.

The carrier is appropriately selected depending on the intended purpose without any restriction, but it is preferably a carrier containing a core, and a resin layer coating the core.

A material of the core is appropriately selected from materials known in the art depending on the intended purpose without any restriction, and is preferably, for example, selected from a manganese-strontium (Mn—Sr) based material of 50 emu/g to 90 emu/g, a manganese-magnesium (Mn—Mg) based material of 50 emu/g to 90 emu/g. In order to attain secure a sufficient image density, use of a high magnetic material, such as iron powder (100 emu/g or higher) and magnetite (75 emu/g to 120 emu/g), is preferable. Moreover, a weak magnetic material such as a cupper-zinc (Cu—Zn) based material (30 emu/g to 80 emu/g) is preferable because the resulting carrier enables to reduce the impact of the toner brush onto a photoconductor, and therefore it is advantageous for forming high quality images. These may be used alone or in combination.

The volume average particle diameter of the cores is appropriately selected depending on the intended purpose without any limitation, but it is preferably 10 μm to 150 μm, more preferably 20 μm to 80 μm.

When the average particle diameter (volume average particle diameter (D50)) of the cores is smaller than 10 μm, a proportion of fine particles in the carrier increases, and magnetic force per particle reduces, which may cause scattering of the carrier. When the average particle diameter thereof is greater than 150 μm, specific surface area thereof decreases, and therefore scattering of a toner may be caused. Especially in the case of a full color image having a large area of a solid image, reproducibility of the solid area may be impaired.

A material of the resin layer is appropriately selected from resins known in the art depending on the intended purpose without any limitation, and examples thereof include an amino-based resin, a polyvinyl-based resin, a polystyrene-based resin, a halogenated olefin resin, a polyester-based resin, a polycarbonate-based resin, a polyethylene resin, a polyvinyl fluoride resin, a polyvinylidene fluoride resin, a polytrifluoroethylene resin, a polyhexafluoropropylene resin, a copolymer of vinylidene fluoride an acryl monomer, a copolymer of vinylidene fluoride and vinyl fluoride, a fluoroterpolymer (e.g., a terpolymer of tetrafluoroethylene, vinylidene fluoride, and a non-fluoro monomer), and a silicone resin. These may be used alone, or in combination.

Examples of the amino-based resin include a urea-formaldehyde resin, a melamine resin, a benzoguanamine resin, a urea resin, a polyamide resin, and an epoxy resin. Examples of the polyvinyl-based resin include an acrylic resin, a polymethyl methacrylate resin, a polyacrylonitrile resin, a polyvinyl acetate resin, a polyvinyl alcohol resin, and a polyvinyl butyral resin. Examples of the polystyrene-based resin include a polystyrene resin, and a styrene-acryl copolymer resin. Examples of the halogenated olefin resin include polyvinyl chloride. Examples of the polyester-based resin include a polyethylene terephthalate resin, and polybutylene terephthalate resin.

The resin layer optionally contains an electroconductive powder, and examples of the electroconductive powder include a metal powder, carbon black, titanium oxide, tin oxide, and zinc oxide. The average particle diameter of the electroconductive powder is appropriately selected depending on the intended purpose without any limitation, but it is preferably 1 μm or smaller. When the average particle diameter thereof is greater than 1 μm, it may be difficult to control electric resistance.

The resin layer can be formed, for example, by dissolving the silicone resin in a solvent to prepare a coating solution, uniformly coating surfaces of the cores with the coating solution by a conventional coating method, drying the coating solution, and baking the coated cores. Examples of the coating method include dipping, spraying, and brush coating.

The solvent is appropriately selected depending on the intended purpose without any limitation, and examples thereof include toluene, xylene, methyl ethyl ketone, methyl isobutyl ketone, and cellosolve butyl acetate.

The baking is not particularly limited, and it may be performed by an external heating system or internal heating system. Examples of a method for the baking include a method using a fix electric furnace, a flow electric furnace, a rotary electric furnace, or a burner furnace, and a method using microwaves.

An amount of the resin layer in the carrier is appropriately selected depending on the intended purpose without any limitation, but it is preferably 0.01% by mass to 5.0% by mass. When the amount thereof is smaller than 0.01% by mass, a uniform resin layer may not be formed on a surface of a core. When the amount thereof is greater than 5.0% by mass, a thickness of the resin layer becomes excessively thick so that a plurality of carrier particles may form into one particle, and therefore uniform carrier particles cannot be obtained.

In the case where the developer is a two-component developer, an amount of the carrier in the two-component developer is appropriately selected depending on the intended purpose without any limitation, and for example, it is preferably 90% by mass to 98% by mass, more preferably 93% by mass to 97% by mass.

<Developer Container>

A developer container for use in the present invention houses the toner of the present invention. The container is appropriately selected without any limitation, and examples thereof include a container having a container main body and a cap. The size, shape, structure and material of the developer container main body are appropriately selected depending on the intended purpose without any limitation. The shape of the developer container main body is, for example, preferably a cylinder, and particularly preferably a configuration of the container main body, in which recess (a convexo-concave shape) is spirally formed in the internal circumference surface to thereby enable the content, that is the toner, to move to the side of the discharging outlet by rotation of the container main body, and the part of or entire spiral recess section functions as bellows. The material of the container is appropriately selected depending on the intended purpose without any limitation, but it is preferably selected from materials that are excellent in dimensional accuracy on the production. Examples thereof include a polyester resin, a polyethylene resin, a polypropylene resin, a polystyrene resin, a polyvinyl chloride resin, polyacrylic acid, a polycarbonate resin, an ABS resin, and a polyacetal resin.

The developer container is easy to store and transport, excellent in handling, and can be suitably used in the process cartridge or image forming apparatus mentioned later to supply a developer by detachably mounting the developer container therein.

(Image Forming Apparatus and Image Forming Method)

The image forming apparatus of the present invention contains at least a latent electrostatic image bearing member, a charging unit, an exposing unit, a developing unit, a transferring unit, a fixing unit, and a cleaning unit, and may further contain appropriately selected other units, such as a diselectrification unit, a recycling unit, and a controlling unit. Note that, the charging unit and the an exposing unit may be collectively referred to as a latent electrostatic image forming unit.

The image forming method for use in the present invention contains at least a charging step, an exposing step, a developing step, a transferring step, a fixing step, and a cleaning step, and may further contain appropriately selected other steps, such as a diselectrification step, a recycling step, and a controlling step. Note that, the charging step and the exposing step may be collectively referred to as a latent electrostatic image forming step.

The image forming method for use in the present invention can be suitably performed by means of the image forming apparatus of the present invention. The charging step can be performed by the charging unit, the exposing step can be performed by the exposing unit, the developing step can be performed by the developing unit, the transferring step can be performed by the transferring unit, the fixing step can be performed by the fixing unit, the cleaning step can be performed by the cleaning unit, and the aforementioned other steps can be performed by the aforementioned other units.

A process linear velocity of the image forming apparatus of the present invention is appropriately selected depending on the intended purpose without any limitation, but it is preferably 300 mm/s to 1,500 mm/s.

Moreover, the image forming method for use in the present invention is preferably a full-color image forming method, and preferably employs a tandem-type electrophotographic image forming process.

In the full-color image forming method, the linear velocity of the toner image transferring to a recording medium in a secondary transferring step is appropriately selected depending on the intended purpose without any limitation, but it is preferably 300 mm/sec to 1,000 mm/sec. More preferably, the transfer time at the nip in the secondary transferring unit is 0.5 msec to 20 msec.

<Latent Electrostatic Image Bearing Member>

A material, shape, structure, and size of the latent electrostatic image bearing member (may be referred to as a "electrophotographic photoconductor" or "photoconductor" hereinafter) are appropriately selected from those known in the art without any limitation. The shape thereof is preferably a drum shape. Preferable examples of the material thereof include inorganic photoconductor (e.g., amorphous silicon, and selenium) and organic photoconductor (e.g., polysilane, and phthalopolymethine). Among them, amorphous silicon is preferable in view of a long service life.

As for the amorphous silicon photoconductor, for example, a photoconductor having a photoconductive layer formed of a-Si (may also referred to as an "a-Si photoconductor" hereinafter), obtained by heating a substrate to 50° C. to 400° C., followed by forming the photoconductive layer on the substrate by a film forming method such as vacuum deposition, sputtering, ion plating, thermal CVD, photo CVD, and plasma CVD, can be used. Among them, the plasma CVD, i.e., a method where raw material gas is decomposed by DC, or high frequency microwave glow discharge, to deposit a-Si film on the substrate, is preferable.

<Charging Step and Charging Unit>

The charging step is charging a surface of the latent electrostatic image bearing member, and is performed by the charging unit.

The charging can be performed, for example, by applying a voltage to the surface of the latent electrostatic image bearing member using the charging unit.

The charging unit is appropriately selected depending on the intended purpose without any limitation, and examples thereof include: conventional contact charging units equipped with an electric conductive or semiconductive roller, brush, film or rubber blade; and non-contact chargers utilizing corona discharge such as corotron, and scorotron.

The shape of the charging unit may be in the shape of a magnetic brush or fur brush, other than the roller, and the shape thereof can be appropriately selected depending on the specification and configuration of the image forming apparatus. In the case where a magnetic brush is used as the charging unit, for example, the magnetic brush using various ferrite particles such as Zn—Cu ferrite is used as a charging unit, and the magnetic brush is constructed of these ferrite particles, a non-magnetic electric conductive sleeve for supporting the ferrite particles, and a magnet roller provided inside the sleeve. In the case where the fur brush is used as the charging unit, as for a material of the fur brush, for example, a conductive-processed fur with carbon, copper sulfide, metal or metal oxide is used, and the processed fur is formed into a charging unit by winding the fur around a core bar or pasting the fur onto the core bar, which is formed of a metal or is conductive processed in other manners.

The charging unit is not limited to the contact charging unit, but the use of the contact charging unit is preferable as an image forming apparatus whose a generating amount of ozone is reduced is attained.

The charging unit is preferably disposed in contact with or without being in contact with the latent electrostatic image bearing member and charges a surface of the latent electrostatic image bearing member by applying overlapping direct current voltage and alternating voltage.

Moreover, the charging unit is preferably a charging roller, which has a gapped tape with respect to the latent electrostatic image bearing member to be disposed adjacent to the latent electrostatic image bearing member without being in contact with the latent electrostatic image bearing member, and is configured to charge a surface of the latent electrostatic image bearing member (electrophotographic photoconductor) by applying overlapping direct current voltage and alternating voltage to the charging roller.

Figure 2:
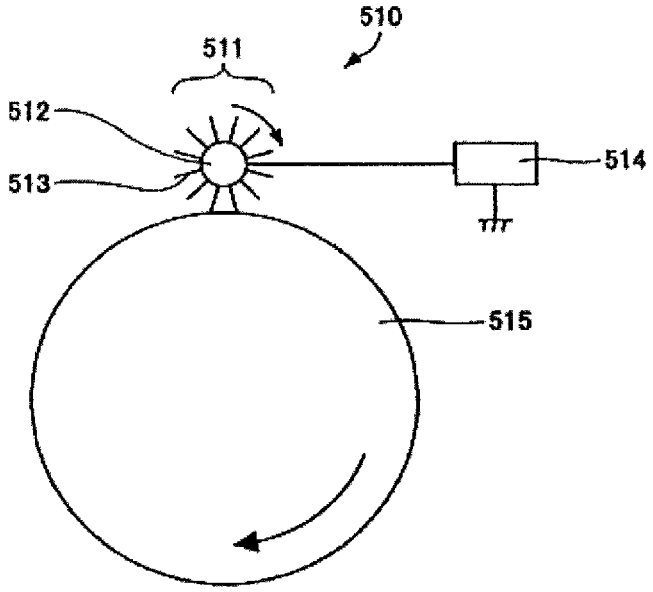
FIG. 2 is a diagram illustrating one example of a brush charging unit used in the image forming apparatus of the present invention.

As for the charging unit, for example, contact charging units illustrated in FIGS. 1 and 2 can be used.

<<Roller Charging Unit>>

A schematic structure of one example of a roller charging unit 500, which is a type of a contact charging unit, is illustrated in FIG. 1. The photoconductor 505, which is an image bearing member to be charged, is rotationally driven in the direction depicted with the arrow depicted in FIG. 1 at the predetermined speed (process speed). The charging roller 501, which is a charging unit provided in contact with the photoconductor 505, contains, as a basic structure, a core metal 502, and an electric conductive rubber layer 503, which is formed on the outer surface of the core metal 502 in the form of a concentric roller. The both ends of the core metal 502 are rotatably supported with axis receiving members, which are not illustrated. Moreover, the core metal 502 is pressed against the photoconductor 505 at certain pressing force by a pressurizing unit (not illustrated). In the example illustrated in FIG. 1, the charging roller 501 is rotated along the rotation of the photoconductor 505. The charging roller 501 is formed by coating the core metal 502 having a diameter of 9 mm with the electric conductive rubber layer 503 having intermediate resistance of about 100,000 Ω·cm to give a diameter of 16 mm to the charging roller 501. The core metal 502 of the charging roller 501 and the power source 504 are electrically connected, and the predetermined bias is applied to the charging roller 501 from the power source 504. As a result, the outer surface of the photoconductor 505 is uniformly charged with predetermined polarity and potential.

<<Fur Brush Charging Unit>>

An embodiment of the charging unit for use in the present invention may be, other than the roller charging unit, any of a magnetic brush charging unit, or a fur brush charging unit, and the embodiment thereof can be selected depending on the specification or embodiment of the electrophotographic device. In the case where a magnetic brush is used as the charging unit, for example, the magnetic brush using various ferrite particles such as Zn—Cu ferrite is used as a charging unit, and the magnetic brush is constructed of these ferrite particles, a non-magnetic electric conductive sleeve for supporting the ferrite particles, and a magnet roller provided inside the sleeve. In the case where the fur brush is used as the charging unit, as for a material of the fur brush, for example, a conductive-processed fur with carbon, copper sulfide, metal or metal oxide is used, and the processed fur is formed into a charging unit by winding the fur around a core bar or pasting the fur onto the core bar, which is formed of a metal or is conductive processed in other manners.

One example of the schematic structure of the contact fur brush charging unit 510 is depicted in FIG. 2. The photoconductor 515, which is an image bearing member to be charged, is driven to rotate in the direction shown with the arrow depicted in FIG. 2 at the predetermined speed (process speed). The far brush roller 511 composed of a fur brush is brought into contact with the photoconductor 515 with the predetermined nip with the pressing force against elasticity of the brush part 513.

The fur brush 511 as a contact charging unit in this example is, for example, a roll brush having an outer diameter of 14 mm and a longer-direction length of 250 mm, formed by spirally winding a tape, which is a terry of electroconductive rayon fibers REC-B manufactured by UNITIKA LTD. as a brush part 513 around a metal core 512 having a diameter of 6 mm also serving as an electrode. The brush of the brush part 513 is, for example, 300 denier/50 filaments, and has a density of 155 filaments/$mm^2$. This roll brush is inserted into a pipe having an inner diameter of 12 mm with rotating one direction, and is designed to be concentric to the pipe. Then, the roll brush is left to stand in high temperature high humidity atmosphere to make the fibers slanted.

The resistance of the fur brush roller 511 is $1\times10^5\Omega$ with the applied voltage of 100 V. The resistance is determined by converting the electric current passed through when the fur brush roller is earthed to a metal drub having a diameter of 30 mm with a nip width of 3 mm, and voltage of 100 V is applied. The resistance of the brush charging device 510 needs to be $10^4\Omega$ or greater, in order to prevent image failures, which is caused due to a charging failure at a charging nip, which is caused by excessive leak current run into the low pressure resistant defects, such as pin holes, formed on the photoconductor 515 to be charged. Moreover, in order to sufficiently inject charge into the surface of the photoconductor 515, the resistance needs to be $10^7\Omega$ or less.

Examples of the material of the brush include, other than REC-B manufactured by UNITIKA LTD., REC-C, REC-M1, and REC-M10 of UNITIKA LTD., SA-7 of Toray Industries, Inc., Thunderon of Nihon Sanmo Dyeing Co., Ltd., Belltron of KB seiren, Kuracarb of KURARY CO., LTD., a material in which carbon is dispersed in rayon, and Royal of Mitsubishi Rayon Co., Ltd. It is preferred that each fiber of the brush be 3 denier to 10 denier, and the brush fibers have 10 filaments/bundle to 100 filaments/bundle, and the brush have a density of 80 filaments/$mm^2$ to 600 filaments/$mm^2$. The length of the fiber is appropriately selected depending on the intended purpose without any limitation, but it is preferably 1 mm to 10 mm.

The fur brush roller 511 is driven to rotate in the counter direction to the rotational direction of the photoconductor 515 at the predetermined peripheral velocity (speed of the surface), and is brought into contact with the surface of the photoconductor with a difference in the rotational speed. Then, the predetermined charging voltage is applied to the brush roller 511 from the power source 514, to thereby give the predetermined polarity and uniform potential to the surface of the rotating photoconductor in a contact manner.

In this example, contact charging of the photoconductor 515 by the fur brush 511 is dominantly performed with direct injection of charge, and the surface of the rotating photoconductor is charged to the potential, which is substantially the same to the applied charging voltage to the fur brush roller 511.

An embodiment of the charging member (charging unit) for use in the present invention may be, other than the fur brush roller 511, any embodiment, such as a charging roller, and a fur brush, which is selected depending on the specification or embodiment of the electrophotographic device. In case of the charging roller, it is common that the charging roller contain a core, and a rubber layer having an intermediate resistance of about 100,000 Ω·cm, and covering the core. In case of the magnetic brush, the magnetic brush uses, for example, various ferrite particles, such as Zn—Cu ferrite, as a charging member, and the magnetic brush charging device contains a non-magnetic electric conductive sleeve configured to support the magnetic brush, and a magnet roll provided inside and covered with the electric conductive sleeve.

As for the magnetic brush as the contact charging member in this example, for example, usable is coated magnetic particles prepared by mixing Zn—Cu ferrite particles having the average particle diameter of 25 μM and Zn—Cu ferrite particles having the average particle diameter of 10 μm at a mass ratio of 1:0.05, and coating the ferrite particles having the average particle diameter of 25 μm and having peaks at the aforementioned average particle diameters, with an intermediate resistance resin layer. The contact charging member is composed of, for example, the aforementioned coated magnetic particles, a non-magnetic electric conductive sleeve configured to support the coated magnetic particles, and a magnet roll provided inside the electric conductive sleeve. The coated magnetic particles are coated on the sleeve to give a thickness of 1 mm, to thereby form a charging nip having a width of about 5 mm to the photoconductor. Moreover, a space between the magnetic particle bearing sleeve and the photoconductor is, for example, about 500 μm. Moreover, the magnetic roll is rotated in the opposite direction to the rotational direction of the photoconductor in the manner that the surface of the sleeve is rubbed against the surface of the photoconductor twice the speed of the peripheral velocity of the photoconductor surface. As a result, the photoconductor and the magnetic brush are uniformly brought into contact with each other.

<Exposing Step and Exposing Unit>

The exposing step is exposing the charged surface of the latent electrostatic image bearing member to light, and is performed by the exposing unit.

The exposing can be performed, for example, by exposing the surface of the latent electrostatic image bearing member to imagewise light using the exposing unit.

An optical device used in the exposing is roughly classified into an analog optical device and a digital optical device. The analog optical device is an optical device for projecting a document directly to the latent electrostatic image bearing member, and the digital optical device is an optical device which receives image information as electric signals and converting the electric signals into optical signals, which are applied to the electrophotographic photoconductor for the exposure, to thereby form an image thereon.

The exposing unit is appropriately selected depending on the intended purpose without any restriction, provided that it can expose the charged surface of the latent electrostatic image bearing member by the charging unit to light imagewise corresponding to an image to be formed. Examples thereof include various exposing devices, such as a reproduction optical exposing device, a rod-lens array exposing device, a laser optical exposure device, and a liquid crystal shutter optical device.

In the present invention, a back light system, where the imagewise exposing is performed from the back side of the latent electrostatic image bearing member, may be employed.

<Developing Step and Developing Unit>

The developing step is developing the latent electrostatic image with the toner of the present invention and/or the developer to form a visible image.

The formation of the visible image can be performed, for example, by developing the latent electrostatic image with the toner of the present invention and/or the developer, and can be performed by the developing unit.

The developing unit is not particularly restricted, and can be appropriately selected from the conventional developing units, as long as it is capable of performing development using the toner of the present invention and/or the developer. For example, the developing unit is suitably a unit having at least a developing device housing the toner of the present invention and/or the developer and capable of applying the toner and/or the developer to the latent electrostatic image in a contact or non-contact manner. The developing unit is more preferably a developing device equipped with a container housing the toner of the present invention.

The developing device may be employ a dry developing system, or wet developing system, and may be a developing device for a singly color, or a developing device for a multicolor. Preferable examples of the developing device include a device having a stirrer configured to charge the toner or developer by frictions from stirring, and a rotatable magnetic roller.

In the developing device, for example, the toner and the carrier are mixed and stirred, and the toner is charged by the friction from the stirring. The charged toner is held on the surface of the rotatable magnetic roller in the form of a brush to form a magnetic brush. The magnetic roller is provided adjacent to the latent electrostatic image bearing member, part of the toner forming the magnetic brush on the surface of the magnetic roller is moved to the surface of the latent electrostatic image bearing member by electrical attraction force. As a result, the latent electrostatic image is developed with the toner to form a visible image on the surface of the latent electrostatic image bearing member.

The developed housed in the developing unit is the developer containing the toner, and the developer may be a one-component developer, or two-component developer. The toner contained in the developer is the toner of the present invention.

Figure 3:
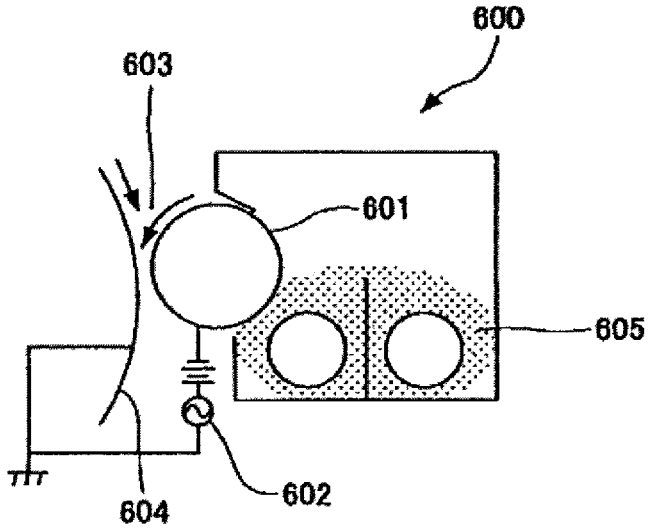
FIG. 3 is a diagram illustrating one example of a developing unit used in the image forming apparatus of the present invention.

When a latent electrostatic image of the photoconductor is developed, alternating electric field is preferably applied. In the developing device (developing unit) 600 illustrated in FIG. 3, oscillation bias voltage, in which AC voltage is overlapped with DC voltage, is applied as developing bias to the developing sleeve 601 from the power source 602 during the developing. The potential of the back ground and the potential of the image area are between the maximum value and the minimum value of the oscillation bias potential. In this manner, the alternating electric field, whose direction is alternately changed, is formed at the developing device 603. In this alternating electric field, the toner and carrier of the developer are intensely oscillated so that the toner 605 jumps to the photoconductor 604 with beating the electrostatic force to the developing sleeve 601 and the carrier. Then, the toner is deposited on the photoconductor 604 corresponding to a latent electrostatic image. Note that, the toner 605 is the aforementioned toner of the present invention.

The difference between the maximum value and the minimum value (peak-to-peak voltage) of the oscillation bias voltage is preferably 0.5 kV to 5 kV, and the frequency thereof is preferably 1 kHz to 10 kHz. The wave form of the oscillation bias voltage may be square wave, sine wave, or triangular wave. The DC voltage component of the oscillation bias is the value between the potential of the back ground and the potential of the image area, and it is preferably the value closer to the potential of the back ground than the potential of the image area in order to prevent the deposition of the toner on the back ground potential area.

In the case where the wave form of the oscillation bias voltage is square wave, the duty ratio is preferably 50% or lower. The duty ratio is a ratio of the time for the toner to traveling to the photoconductor in one cycle of the oscillation bias. By setting the duty ratio in the aforementioned manner, a difference between the peak value and the average value of the time of the bias when the toner travels to the photoconductor can be increased. Therefore, the movement of the toner is enhanced, so that the toner is accurately deposited in accordance with the potential distribution on the latent image surface and texture and resolution of the image can be improved. Moreover, a difference between the peak value and the average value of the bias for the carrier, which has a reverse polarity to that of the toner, to travel to the photoconductor is reduced, and therefore the movement of the carrier is subsided, and a possibility of the carrier to deposit on the back ground of the latent image can be significantly reduced.

<Transferring Step and Transferring Unit>

The transferring step is transferring the visible image to a recording medium. The transferring step is preferably a step using an intermediate transfer member, in which the visible image is primary transferred to the intermediate transfer member, and then the visible image is secondary transferred to the recording medium. The transferring step is more preferably a step, which uses a two or more colors of the toner, preferably a full-color toner, and contains a first transferring step, in which visible images are transferred to an intermediate transfer member to form a composite transfer image, and a secondary transferring step, in which the composite transfer image is transferred to a recording medium.

The transferring can be performed, for example, by charging the latent electrostatic image bearing member to charge the visible image using a transfer charger, and can be performed by the transferring unit. A preferable embodiment of the transferring unit contains a primary transferring unit configured to transfer visible images to an intermediate transfer member to form a composite transfer image, and a secondary transferring unit configured to transfer the composite transfer image to a recording medium.

The intermediate transfer member is appropriately selected from conventional transfer members depending on the intended purpose without any limitation, and it is, for example, preferably a transfer belt.

The transferring unit (the primary transferring unit, the secondary transferring unit) preferably contains at least a transfer device configured to charge the visible image formed on the latent electrostatic image bearing member to release the visible image from the photoconductor to the side of the recording medium. The number of the transfer devices equipped may be 1, or 2 or more. Examples of the transfer device include a corona transfer device utilizing corona discharge, a transfer belt, a transfer roller, a pressure transfer roller, and an adhesion transfer member.

The recording medium is typically plain paper, but it is appropriately selected depending on the intended purpose without any limitation, provided that a developed unfixed image can be transferred thereon. A PET base for OHP can also be used as the recording medium.

The intermediate transfer belt will be explained next. The intermediate transfer belt is preferably a single layer resin layer, but it may further contain an elastic layer or a surface layer, if necessary.

A resin material constituting the resin layer is appropriately selected depending on the intended purpose without any limitation, and examples thereof include: polycarbonate; a fluororesin (e.g., ETFE, and PVDF); a styrene-based resin (a homopolymer or copolymer containing styrene or a styrene substituent), such as polystyrene, chloropolystyrene, poly-α-methylstyrene, a styrene-butadiene copolymer, a styrene-vinyl chloride copolymer, a styrene-vinyl acetate copolymer, a styrene-maleic acid copolymer, a styrene-acrylic acid ester copolymer (e.g., a styrene-methyl acrylate copolymer, a styrene-ethyl acrylate copolymer, a styrene-butyl acrylate copolymer, a styrene-octyl acrylate copolymer, and a styrene-phenyl acrylate copolymer), a styrene-methacrylic acid ester copolymer (e.g., a styrene-methyl methacrylate copolymer, a styrene-ethyl methacrylate copolymer, and a styrene-phenyl methacrylate copolymer), a styrene-methyl-α-chloroacrylate copolymer, and styrene-acrylonitrile-acrylic acid ester copolymer; a methyl methacrylate resin; a butyl methacrylate resin; an ethyl acrylate resin; a butyl acrylate resin; a modified acryl resin (e.g., a silicone-modified acryl resin, a vinyl chloride resin-modified acryl resin, and an acryl-urethane resin); a vinyl chloride resin; a styrene-vinyl acetate copolymer; a vinyl chloride-vinyl acetate copolymer; a rosin-modified maleic acid resin; a phenol resin; an epoxy resin; a polyester resin; a polyester polyurethane resin; polyethylene; polypropylene; polybutadiene; polyvinylidene chloride; an iomer resin; a polyurethane resin; a silicone resin; a ketone resin; an ethylene-ethyl acrylate copolymer; a xylene resin; a polyvinyl butyral resin; a polyamide resin; and a modified polyphenylene oxide resin. These may be used alone, or in combination.

An elastic material (an elastic rubber or elastomer) constituting the elastic layer is appropriately selected depending on the intended purpose without any limitation, and examples thereof include butyl rubber, fluororubber, acrylic rubber, EPDM, NBR, acrylonitrile-butadiene-styrene rubber, natural rubber, isoprene rubber, styrene-butadiene rubber, butadiene rubber, ethylene-propylene rubber, ethylene-propylene terpolymer, chloroprene rubber, chlorosulfonated polyethylene, polyethylene chloride, urethane rubber, syndiotactic 1,2-polybutadiene, epichlorohydrin rubber, silicone rubber, fluorine rubber, polysulfide rubber, polynorbornene rubber, hydrogenated nitrile rubber, and thermoplastic elastomer (e.g., polystyrene-based elastomer, polyolefin-based elastomer, polyvinyl chloride-based elastomer, polyurethane-based elastomer, polyamide-based elastomer, polyurea-based elastomer, polyester-based elastomer, and fluororesin-based elastomer). These may be used alone, or in combination.

A material of the surface layer is appropriately selected depending on the intended purpose without any limitation, but it is required to reduce the adhesion of the toner to the surface of the intermediate transfer belt, and to enhance the secondary transfer properties. For example, preferred is a material having a small surface energy and high lubricity, and using one or two or more selected from polyurethane, polyester, an epoxy resin, and the like. As for such material, for example, usable is a material in which powder (e.g., a fluororesin, a fluorine compound, carbon fluoride, titanium dioxide, and silicon carbide), one type or two or more types of particles, or particles having different particles diameters are dispersed. Moreover, a material having a fluorine-rich layer at a surface, such as a fluororubber material, by performing a thermal treatment to make the surface energy thereof small can be used.

To the resin layer and elastic layer, a resistance adjusting conductant agent is added. The resistance adjusting conductant agent is appropriately selected depending on the intended purpose without any limitation, and examples thereof include: metal powder such as carbon black, graphite, aluminum, and nickel; and electric conductive metal oxide, such as tin oxide, titanium oxide, antimony oxide, indium oxide, potassium titanate, antimony oxide-tin oxide complex oxide (ATO), and indium oxide-tin oxide complex oxide (ITO). The electric conductive metal oxide may be insulating particles (e.g., barium sulfate, magnesium silicate, and calcium carbonate) each having an electroconductive coating.

<Fixing Step and Fixing Unit>

The fixing step is fixing the transferred toner image onto the recording medium, and the fixing can be performed using the fixing unit. In the case where two or more colors of the toner are used, fixing may be performed every time when an image formed of the toner of each color is transferred onto the recording medium. Alternatively, fixing may be performed after the toners of all the colors are transferred to the recording medium in a laminated state. The fixing unit is not particularly limited, and can employ a thermal fixing system using a conventional heat pressurizing member. Examples of the heat pressurizing member include a combination of a heating roller and a pressurizing roller, and a combination of a heating roller, a pressurizing roller, and an endless belt. The heating temperature for the fixing is appropriately selected depending on the intended purpose without any limitation, but it is preferably 80° C. to 200° C. Note that, if required, for example, a conventional optical fixing unit may be used together with the fixing unit.

Figure 4:
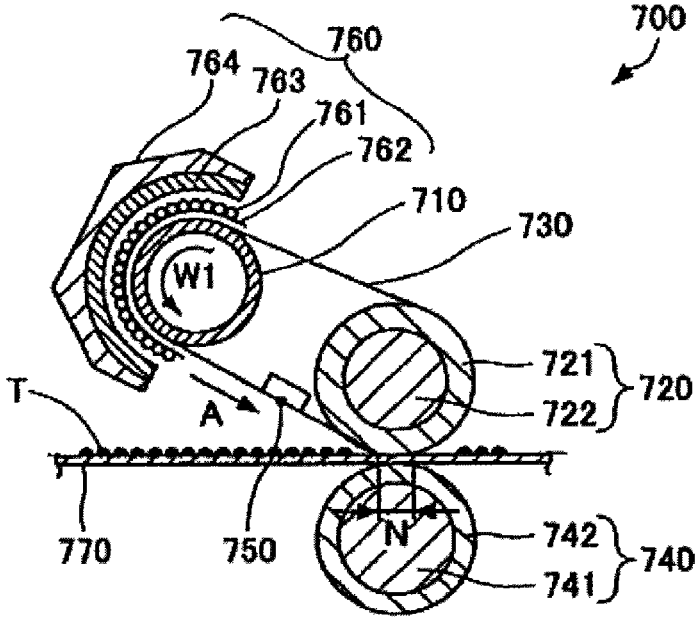
FIG. 4 is a diagram illustrating one example of a fixing unit used in the image forming apparatus of the present invention.

As for the fixing device (fixing unit) for use in the image forming method, for example, a fixing device illustrated in FIG. 4 can be used. The fixing device 700 illustrated in FIG. 4 contain a heating roller 710 which is heated by electromagnetic induction by means of an induction heating unit 760, a fixing roller 720 (a counter roller) provided parallel to the heating roller 710, an endless belt fixing belt (heat resistant belt, toner heating medium) 730, which is supported with the heating roller 710 and the fixing roller 720, is heated by the heating roller 710, and is rotated in the arrow A direction by the rotation of at least one of these rollers, and a pressurizing roller 740 (pressure roller) brought into contact with the fixing roller 720 via the fixing belt 730 with a certain pressure, and is rotated in the same direction to the rotation of the fixing belt 730.

The heating roller 710 is composed of a hollow cylindrical magnetic metal member, which is formed of, for example, iron, cobalt, nickel, or an alloy of these metals, has an outer diameter of, for example, 20 mm to 40 mm, and a radial thickness of, for example, 0.3 mm to 1.0 mm, so that the heating roller 710 has a structure having low thermal capacity and capable of increasing the temperature thereof promptly.

The fixing roller 720 (counter roller) is, for example, composed of a core metal 721 formed of a metal such as stainless steel, and an elastic member 722, which covers the core meal 721 and is formed of solid or foam thermal resistant silicone rubber. Moreover, the outer diameter of the fixing roller 720 is adjusted to about 20 mm to about 40 mm, which is larger than the heating roller 710, in order to form a certain width of a contacting area between the pressurizing roller 740 and the fixing roller 720 by the pressing force from the pressurizing roller 740. The radial thickness of the elastic member 722 is about 4 mm to about 6 mm. As a result of this structure, the thermal capacity of the heating roller 710 becomes smaller than that of the fixing roller 720, and therefore the heating roller 710 is rapidly heated to thereby reduce warm-up time.

The fixing belt 730 supported with the heating roller 710 and the fixing roller 720 is heated at a contact area W1 with the heating roller 710 heated by the induction heating unit 760. Then, the inner surface of the fixing belt 730 is continuously heated by the rotations of the heating roller 710 and the fixing roller 720. As a result, the entire belt is heated.

Figure 5:
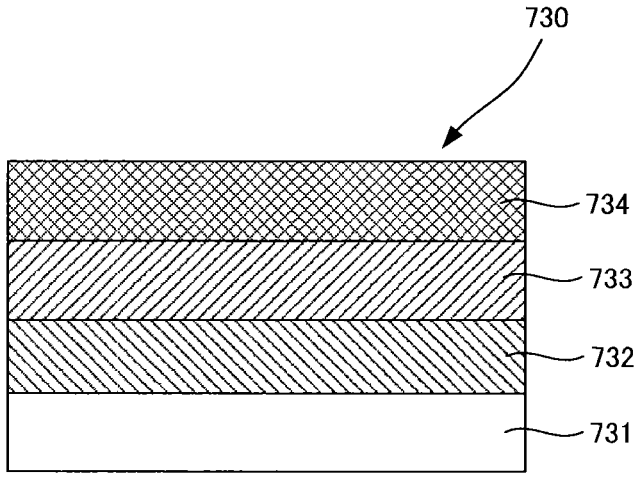
FIG. 5 is a diagram illustrating one example of a layer structure of a fixing belt used as a fixing unit.

A layer structure of the fixing belt 730 is depicted in FIG. 5. The structure of the fixing belt 730 contains the following four layers from the inner layer to the surface layer.

Base 731: a resin layer formed of polyimide (PI) resin or the like

Heat generating layer 732: an electroconductive material layer, formed of Ni, Ag, SUS, or the like Intermediate layer 733: an elastic layer for achieving uniform fixing Releasing layer 734: a releasing layer formed of a fluororesin material or the like, for achieving a releasing effect and oil-less fixing A thickness of the releasing layer 734 is appropriately selected depending on the intended purpose without any limitation, but it is preferably 10 μm to 300 μm, particularly preferably 200 μm.

In the fixing device 700 illustrated in FIG. 4, a surface layer of such fixing belt 730 can sufficiently cover a toner layer (T) formed on the recording medium 770 corresponding to its shape, and therefore, the toner image (T) can be uniformly heated and melted. In order to maintain abrasion resistance of the surface releasing layer over time, the thickness of the releasing layer 734 needs to be 10 μm at the minimum. When the thickness of the releasing layer 734 is greater than 300 μm, a thermal capacity of the fixing belt 730 increases, and therefore the time required for warming up becomes long. Moreover, the surface temperature of the fixing belt 730 is difficult to be decreased during the fixing step, an effect of aggregating melted toner particles cannot attained at an outlet of the fixing unit, and the releasing properties of the fixing belt 730 is decreased. As a result, the toner of the toner image (T) is adhered to the fixing belt 730 to thereby cause, so-called hot offset. Note that, as the base of the fixing belt 730, the heat generating layer 732 formed of a metal may be used, or a resin layer having thermal resistance, such as a fluororesin, a polyimide resin, polyamide resin, a polyamide imide resin, a PEEK resin, a PES resin, and a PPS resin, may be used.

The heating roller 740 contains, for example, a core metal 741 formed of a metal cylindrical material having high thermal conductivity, such as cupper and aluminum, and an elastic member 742 having high thermal resistance and toner releasing properties, and provided on the surface of the core metal 741. As for the core metal 741, other than the aforementioned metals, SUS may be used. The pressurizing roller 740 is pressed against the fixing roller 720 via the fixing belt 730 to form a fixing nip (N). In the present embodiment, the pressurizing roller 740 is penetrated into the fixing roller 720

(and the fixing belt 730) by adjusting the hardness of the pressurizing roller 740 to be higher than that of the fixing roller 720. Because of this penetration, the recording medium 770 travels along the cylindrical shape of the surface of the pressurizing roller 740, and therefore the recording medium 770 is easily released from the surface of the fixing belt 730. The outer diameter of the pressurizing roller 740 is similar to that of the fixing roller 720, and is about 20 mm to about 40 mm, but the radial thickness thereof is about 0.5 mm to about 2.0 mm, which is thinner than that of the fixing roller 720.

The induction heating unit 760 configured to heat the heating roller 710 by electromagnetic induction contains, as illustrated in FIG. 4, an excitation coil 761, which is a magnetic field generating unit, and a coil guide plate 762 around which the excitation coil 761 is wound. The coil guide plate 762 is provided closely to the outer surface of the heating roller 710 and has a semi-cylindrical shape. The excitation coil 761 is one long excitation coil wire alternately wound with respect to the axial direction of the heating roller 710 along the coil guide plate 762. Note that, the excitation coil 761 is connected to a driving power source (not illustrated) in which frequency of an oscillation circuit is variable. At the outer side of the excitation coil 761, a semi-cylindrical excitation coil core 763, which is formed of a ferromagnetic material, such as ferrite, is fixed with an excitation coil core supporting member 764, and is provided adjacent to the excitation coil 761.

<Cleaning Step and Cleaning Unit>

The cleaning step is removing the toner remained on the latent electrostatic image bearing member, and can be suitably performed by the cleaning unit.

The cleaning unit is appropriately selected from conventional cleaners without any limitation, provided that it is capable of removing the toner remained on the latent electrostatic image bearing member, and preferable examples thereof include a magnetic brush cleaner, an electrostatic brush cleaner, a magnetic roller cleaner, a blade cleaner, a brush cleaner, and a web cleaner.

<Other Steps and Other Units>

—Diselectrification Step and Diselectrification Unit—

The diselectrification step is applying a diselectrification bias to the latent electrostatic image bearing member for diselectrification thereof, and is suitably performed by the diselectrification unit.

The diselectrification unit is appropriately selected from conventional diselectrification units without any limitation, provided that it is capable of applying a diselectrification bias to the latent electrostatic image bearing member, and preferable examples thereof include a diselectrification lamp.

—Recycling Step and Recycling Unit—

The recycling step is recycling the toner removed in the cleaning step to the developing unit, and is suitably performed by the recycling unit.

The recycling unit is not particularly limited, and examples thereof include conventional conveying units.

—Controlling Step and Controlling Unit—

The controlling step is controlling each step, and is suitably performed by the controlling unit.

The controlling unit is appropriately selected depending on the intended purpose without any limitation, provided that it is capable of controlling operations of each unit, and examples thereof include devices such as a sequencer, and a computer.

<Full-Color Image Forming Method and Image Forming Apparatus>

Figure 6:
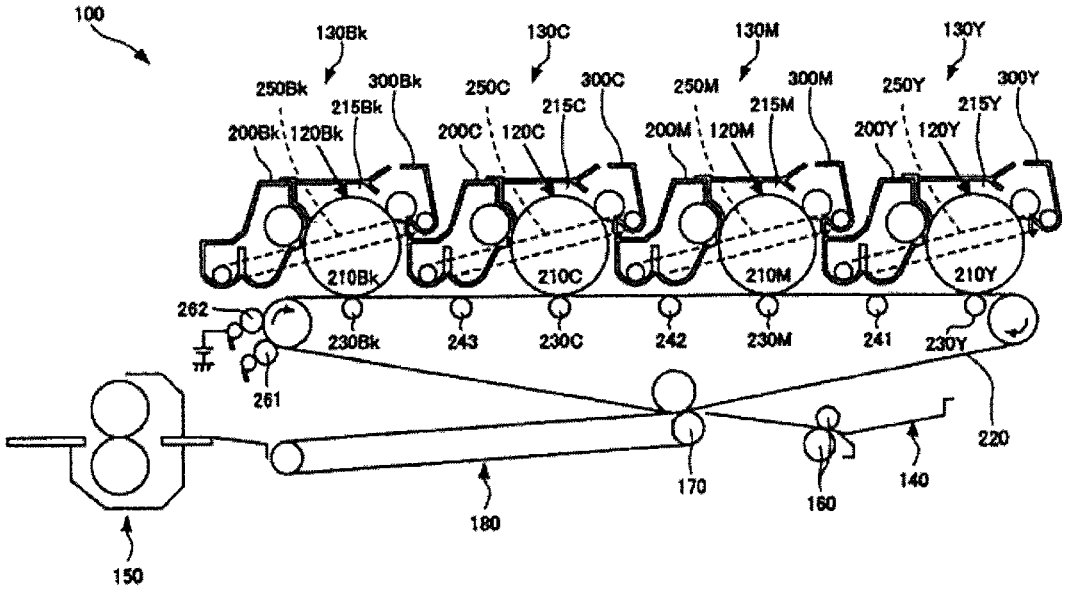
FIG. 6 is a schematic diagram illustrating one example of the image forming apparatus of the present invention.

As for a full-color image forming apparatus as an embodiment of the image forming apparatus of the present invention, for example, a tandem image forming apparatus 100 illustrated in FIG. 6 can be used.

In FIG. 6, the image forming apparatus 100 is mainly composed of image writing units (120Bk, 120C, 120M, 120Y), image forming units (130Bk, 130C, 130M, 130Y), and a paper feeding unit 140, which are for performing color image formation by an electrophotographic process. Image processing is carried out by an image processing unit (not illustrated) based on image signals, to convert to signals of each color, black (Bk), cyan (C), magenta (M), yellow (Y) for image forming, which are transmitted to the image writing units (120Bk, 120C, 120M, 120Y). The image writing units (120Bk, 120C, 120M, 120Y) are, for example, laser scanning optics, composed of a laser source, a polarizer such as a polygonal rotating mirror, a scanning imaging optics, and a group of mirrors (any of these are not illustrated). The image writing units (120Bk, 120C, 120M, 120Y) give four wiring light paths corresponding the aforementioned signals of each color, to write respective images corresponding the aforementioned signals on the image forming units (130Bk, 130C, 130M, 130Y).

The image forming units (130Bk, 130C, 130M, 130Y) are each equipped with a respective photoconductor (210Bk, 210C, 210M, 210Y) for black, cyan, magenta, or yellow. As for these photoconductors (210Bk, 210C, 210M, 210Y), an OPC photoconductor is typically used. In the surrounding area of each photoconductor (210Bk, 210C, 210M, 210Y), a charging device (215Bk, 215C, 215M, 215Y), an exposing unit configured to expose to laser light emitted from the image writing unit (120Bk, 120C, 120M, 120Y), a developing device (200Bk, 200C, 200M, 200Y) for a respective color, a primary transferring device (230Bk, 230C, 230M, 230Y), a cleaning device (300Bk, 300C, 300M, 300Y), and a diselectrification device (not illustrated) are provided. Note that, the developing device (200Bk, 200C, 200M, 200Y) employs a two-component magnetic brush developing system. Moreover, an intermediate transfer belt (220) is provided between each photoconductor (210Bk, 210C, 210M, 210Y) and primary transferring device (230Bk, 230C, 230M, 230Y) to successively transfer and superimpose a toner image of each color from each photoconductor onto the intermediate transfer belt 220, so that the intermediate transfer belt 220 bears the toner images from all of the photoconductors.

In some cases, a pre-transfer charger is provided outside the intermediate transfer belt 220 at the position after passing through the primary transfer position of the final color, and before passing through the secondary transfer position. The pre-transfer charger is to uniformly charge the toner image, which is on the intermediate transfer belt 220 transferred from the photoconductor 210 by the primary transferring unit, to have the identical polarity before being transferred to transfer paper serving as a recording medium.

The toner image transferred on the intermediate transfer belt 220 from each photoconductor (210Bk, 210C, 210M, 210Y) may contain both a half-tone area and a solid area, or an area having a different amount of the toner superimposed. Therefore, the charged amount may be varied in the toner image. Moreover, there are cases where the charge amount is varied in the toner image on the intermediate transfer belt 220 after the primary transferring because of release discharging caused in a space located adjacent to and downstream of the primary transferring unit in the traveling direction of the intermediate transfer belt. Such variation in the charged amount within the same toner image may restrict a transfer margin for the secondary transferring unit at which the toner image on the intermediate transfer belt 220 is transferred to transfer paper. Accordingly, the toner image is uniformly charged to the identical polarity to that of the toner image by the pre-transfer charger so that the variation in the charged amount within the same toner image can be eliminated, and the transfer margin for the secondary transferring unit can be improved.

In accordance with the image forming method described above, transfer properties at the secondary transferring unit can be made almost constant in any area of the toner image on the intermediate transfer belt 220, even when there is a variation in the charged amount within the toner image on the intermediate transfer belt, by uniformly charging the toner image transferred from each photoconductor (210Bk, 210C, 210M, 210Y) onto the intermediate transfer belt 220. Accordingly, the reduction in the transfer margin at the time of transferring to transfer paper is inhibited, so that the toner image can be stably transferred.

Note that, in this image forming method, the charged amount of the toner image charged by the pre-transfer charger varied depending on the traveling speed of the intermediate transfer belt 220, which is a subject for charging. For example, if the traveling speed of the intermediate transfer belt 220 is slow, the time required for the one area of the toner image on the intermediate transfer belt 220 to pass through the charging region by the pre-transfer charger becomes long, and therefore the charged amount is large. On the other hand, when the traveling speed of the intermediate transfer belt 220 is fast, the charged amount of the toner image on the intermediate transfer belt 220 is small. Therefore, in the case where the traveling speed of the intermediate transfer belt 220 changes during the period when the toner image on the intermediate transfer belt 220 passes through the charging position by the pre-transfer charger, it is preferred that the pre-transfer charger be controlled corresponding to the traveling speed of the intermediate transfer belt 220, so as not to vary the charging amount to the toner image.

In between the primary transferring devices (230Bk, 230C, 230M, 230Y), electric conductive rollers 241, 242, 243 are provided. After the transfer paper is fed from the paper feeder 140, the transfer paper is carried on the transfer belt 180 via a pair of the registration rollers 160, and the toner image on the intermediate transfer belt 220 is transferred onto the transfer paper by the secondary transfer roller 170 at the position where the intermediate transfer belt 220 and the secondary transfer belt 180 are brought into contact with each other, to thereby perform color image formation.

Then, the transfer paper on which the image has been formed is transported to the fixing device 150 by the secondary transfer belt 180, and the image is fixed to output a color image. The toner remained on the intermediate transfer belt 220 without being transferred is removed from the belt by the intermediate transfer belt cleaning device (not illustrated).

The polarity of the toner on the intermediate transfer belt 220 before being transferred to the transfer paper is negative, which is identical to the polarity thereof at the time of the developing, and therefore a positive transfer bias voltage is applied to the secondary transfer roller 170 to transfer the toner on the transfer paper. The nip pressure here affects the transfer properties, which then largely affect the fixing properties. Moreover, the toner remained on the intermediate transfer belt 220 without being transferred is discharged to give the polarity of the positive side at the time when the transfer paper and the intermediate transfer belt 220 are separated, to thereby control the charge of the toner to 0 to the positive side. Note that, the jammed transfer paper or the toner image formed on the non-imaging area is not influenced from the secondary transferring, and therefore such toner remains to be negatively charged.

For example, a thickness of the photoconductor layer is adjusted to 30 μm, and the beam spot diameter of the optical system is adjusted to 50 μm×60 μm, and the luminous energy is adjusted to 0.47 mW. Then, the developing step is performed with the charging (exposure side) potential V0 of the photoconductor (black) 210Bk being −700 V, the potential VL thereof after the exposure being −120 V, and the developing bias voltage being −470 V, i.e., developing potential being 350 V. The developed image of the toner (black) formed on the photoconductor (black) 210Bk goes through transferring (transferring to the intermediate transfer belt and to the transfer paper), and a fixing step, to be completed as an image. The transferring is performed by initially transferring images of all colors to the intermediate transfer belt 220 by the primary transferring devices (230Bk, 230C, 230M, 230Y), followed by transferring to the transfer paper by applying bias to another secondary transfer roller 170.

Next, the details of the photoconductor cleaning device will be explained. In FIG. 6, each developing device (200Bk, 200C, 200M, 200Y) and each cleaning device (300Bk, 300C, 300M, 300Y) are connected with each toner transporting pipe (250Bk, 250C, 250M, 250Y) (a dashed line in FIG. 6). Inside of each toner transporting pipe (250Bk, 250C, 250M, 250Y), a screw (not illustrated) is provided to transport the toner collected by each cleaning device (300Bk, 300C, 300M, 300Y) to each developing device (200Bk, 200C, 200M, 200Y).

In the conventional direct transfer system using a combination of four photoconductor drums and a belt transferring system, the photoconductor and transfer paper are directly in contact with each other. Therefore, the paper powder is deposited to the toner, and the recycled toner contains the paper powder. Such recycled toner could not be used for image formation as image defects, such as images containing toner-missing area, are caused. Further, in the conventional system using a combination of one photoconductor drum and an intermediate transferring system, deposition of paper powder to the photoconductor during transferring to the transfer paper is eliminated by employing an intermediate transfer member. However, in the case where the residual toner is recycled to the photoconductor, it is practically impossible to separate the toner of different colors once mixed. There is also a suggestion to use the mixed color toner as a black toner, but even when the toner particles of all colors are mixed, the resulting toner cannot make black. Moreover, the colors for use change depending on the print mode, and therefore recycling of the toner has been impossible with the structure containing one photoconductor.

In contrast, the aforementioned full color image forming apparatus uses the intermediate transfer belt 220, and therefore the toner has less contamination of paper powders, and deposition of the paper powder to the intermediate transfer belt 220 during transferring to paper can also be prevented. Since each photoconductor (210Bk, 210C, 210M, 210Y) uses an independent single color toner, it is not necessary to move each photoconductor cleaning device (300Bk, 300C, 300M, 300Y) closer or being apart, and the photoconductor cleaning devices can surely collect only the toner.

The positively charged toner remained on the intermediate transfer belt 220 is cleaned with an electric conductive fur brush 262, to which a negative voltage is applied. A method for applying a voltage to the electric conductive fur brush 262 is identical to that for the electric conductive fur brush 261, provided that the polarity is different. Almost all of the toner remained without being transferred is cleaned with the two electric conductive fur brushes 261, 262. The toner, paper powder, and talc remained without being cleaned with the electric conductive fur brush 262 is negatively charged by the negative voltage of the electric conductive fur brush 262. The primary transfer of the black color, which is a sequential operation, is the transfer performed by a positive voltage, and the negatively charged toner etc. is attracted to the side of the intermediate transfer belt 220, and therefore the migration of the residual toner etc. to the side of the photoconductor (black) 210Bk can be prevented.

Figure 7:
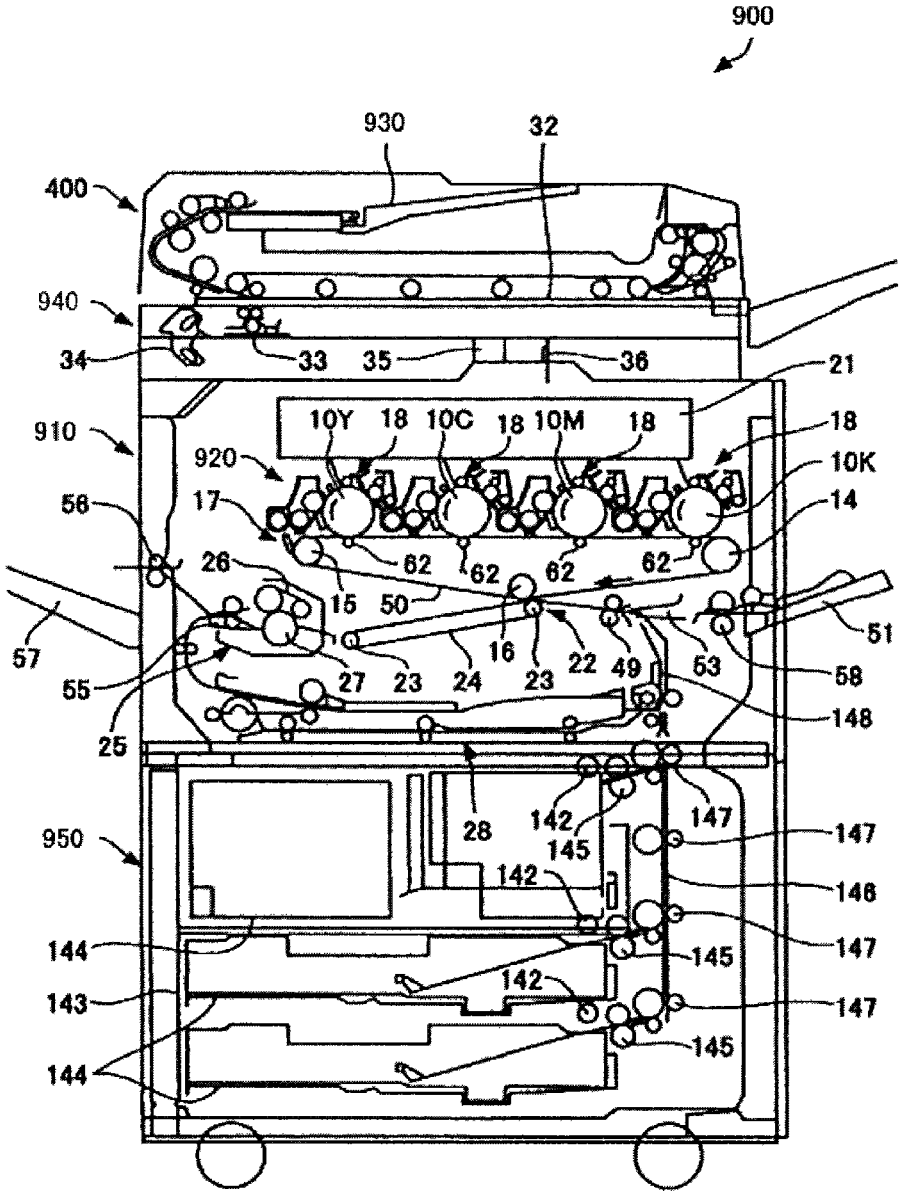
FIG. 7 is a schematic diagram illustrating another example of the image forming apparatus of the present invention.

FIG. 7 illustrates another example of an image forming apparatus for use an image forming method of the present invention, and illustrates an electrophotographic image forming apparatus 900 employing a tandem indirect transfer system. In FIG. 7. 910 is a main body of the image forming apparatus, 950 is a feeding table on which the main body is provided, 940 is a scanner provided on the main body of the image forming apparatus 910, and 400 is an automatic document feeder (ADF) provided on the scanner. In the middle of the main body of the image forming apparatus 910, an intermediate transfer member 50 in the forming of an endless belt is provided. As illustrated in FIG. 7, the intermediate transfer member is supported with three supporting rollers 14, 15, 16, and is configured to rotate in the clockwise direction in the figure. In FIG. 7, an intermediate transfer member cleaning device 17, which is configured to remove the residual toner remained on the intermediate transfer member 50 after transferring images, is provided on the left side of the second supporting roller 15, out of these three rollers. On the upper side of the section of the intermediate transfer member 50, where the intermediate transferring member 50 is supported between the first supporting roller 14 and the second supporting roller 15 out of the three rollers, four image forming units 18 of yellow, cyan, magenta, and black are provided along the conveying direction of the intermediate transfer member 50 to constitute the tandem image forming apparatus 920.

Above the tandem image forming apparatus 920, as illustrated in FIG. 7, an exposing device 21 is provided. On the opposite side of the tandem image forming apparatus 920, a secondary transferring unit 22 is provided with an intermediate transferring member 50 being in between. In the illustrated example, the secondary transferring unit 22 contains a secondary transfer belt 24, which is an endless belt, provided around two rollers 23, and the secondary transfer belt 24 is provided against the third supporting roller 16 with the intermediate transfer member 50 being between them, to thereby transfer an image on the intermediate transfer member 50 to a sheet. Next to the secondary transferring unit 22, a fixing unit 25 configured to fix the transferred image on the sheet is provided. The fixing unit 25 contains a fixing belt 26, which is an endless belt, and a pressing roller 27 provided to press against the fixing belt 26. The aforementioned secondary transferring unit 22 also has a sheet transport faction of transporting the sheet to which the image has been transferred to the fixing unit 25. Of course, a transfer roller or a non-contact charger may be provided as the secondary transferring unit 22, but in such case, it is difficult to provide a sheet transporting function in combination. In the example illustrated in FIG. 7, below the aforementioned secondary transferring unit 22 and fixing unit 25, a sheet reversing device 28 configured to reverse the sheet to perform image recording on both sides of the sheet is provided parallel to the aforementioned tandem image forming apparatus 920.

For making a copy using this color photographic device, a document is set on a document table 930 of the automatic document feeder (ADF) 400. Alternatively, the automatic document feeder (ADF) 400 is opened, a document is set on a contact glass 32 of the scanner 940, and then the ADF 400 is closed.

In the case where the document is set on the ADF 400, once a start switch (not illustrated) is pressed, the document is transported onto the contact glass 32, and then the scanner 940 is driven to scan the document with a first carriage 33 equipped with a light source and a second carriage 34 equipped with a mirror. In the case where the document is set on the contact glass 32, the scanner 940 is immediately driven in the same manner as mentioned. During this scanning operation, light applied from the first carriage 33 is reflected on the surface of the document, the reflected light from the document is further reflected by the second carriage 34, passed through an image forming lens 35 to receive a read sensor 36.

Moreover, when the start switch (not illustrated) is pressed, one of the supporting rollers 14, 15, 16 is driven by a driving motor (not illustrated) to rotate, and other two supporting rollers are rotated dependently to the rotation of the driven roller, to thereby rotate the intermediate transferring member 50. At the same time, a photoconductor of each image forming unit 18 is rotated and a monocolor image of black, yellow, magenta, or cyan is formed on the respective photoconductor. These monocolor images are successively transferred on the intermediate transfer member 50 along the rotation of the intermediate transfer member 50, to thereby form a composite color image on the intermediate transfer member 50.

Meanwhile, as the start switch (not illustrated) is pressed, one of the feeding rollers 142 in the paper feeding table 950 is selectively rotated to eject sheets from one of multiple feeder cassettes 144 of a paper bank 143, the ejected sheets are separated one by one by a separation roller 145 to send to a feeder path 146, and then transported by a transport roller 147 into a feeder path 148 in the image forming apparatus 900. The recording paper transported in the feeder path 148 is then bumped against a registration roller 49 to stop.

Alternatively, sheets on a manual-feeding tray 51 are ejected by rotating the feeding rollers 142, separated one by one by a separation roller 58 to guide into a manual feeding path 53, and then stopped by the registration roller 49.

Then, the registration roller 49 is rotated synchronously with the movement of the composite color image on the intermediate transfer member 50 to send a sheet into the space between the intermediate transfer member 50 and a secondary transferring unit 22, to transfer the composite color image on the sheet by the secondary transferring unit 22. In this manner, the color image is recorded on the sheet.

The sheet on which the image has been transferred is transported by the secondary transferring unit 22 to a fixing unit 25, and the transferred image is then fixed by heat and pressure applied from the fixing unit 25. Next, the sheet is changed its traveling direction by a switch craw 55, and discharged by a discharging roller 56 to be stacked on an output tray 57. Alternatively, the sheet is changed its traveling direction by the switch craw 55 to guide into a sheet reversing device 28, and the sheet is reversed by the sheet reversing device 28 and guided to a transferring position to record an image on the back surface of the sheet, followed by discharging the sheet on the output tray 57 by the discharging roller 56.

The residual toner on the intermediate transfer member 50 from which the image has been transferred is removed by the intermediate transfer member cleaning device 17, to be ready again for image formation performed by the tandem image forming apparatus 920. Note that, the registration roller 49 is generally earthed at the time of the use, but it may be biased for removing paper dust of the recording paper.

<Process Cartridge>

The process cartridge for use in the present invention contains at least a latent electrostatic image bearing member configured to bear a latent electrostatic image, and a developing unit configured to develop, with the toner of the present invention, the latent electrostatic image on the latent electrostatic image bearing member to form a visible image, and may further contain appropriately selected other units, such as a charging unit, a developing unit, a transferring unit, a cleaning unit, and a diselectrification unit, if necessary. In addition, the process cartridge is detachably mounted in a main body of the image forming apparatus.

The developing unit contains at least a developer container housing the toner of the present invention and/or the developer, and a developer bearing member configured to bear the toner and/or developer housed in the developer container and to convey the toner and/or developer, and may further contain other members, such as a layer thickness regulating member configured to regulate a thickness of the toner layer borne on the developer bearing member. The process cartridge of the present invention can be detachably mounted in various electrophotographic image forming apparatuses, facsimiles, and printers, and is preferably detachably mounted in the image forming apparatus of the present invention.

Figure 8:
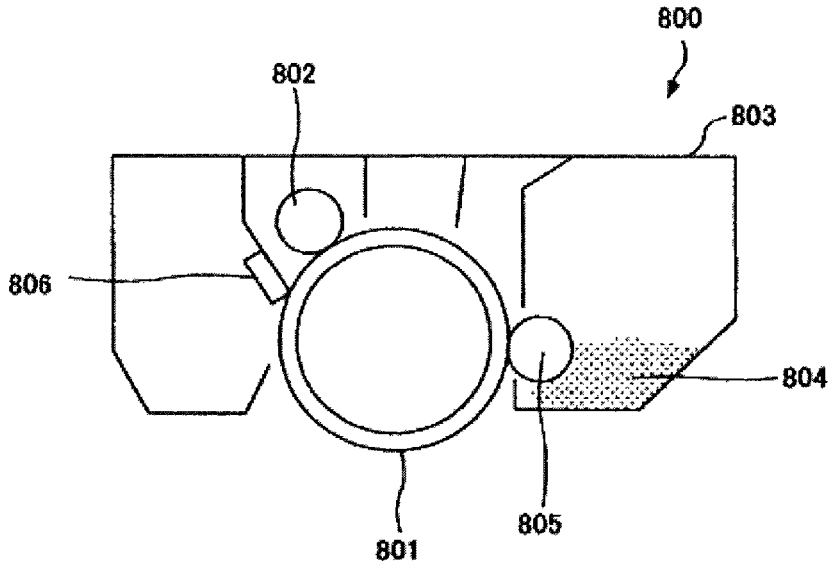
FIG. 8 is a schematic diagram illustrating one example of a process cartridge.

An example of the process cartridge for use in the present invention is illustrated in FIG. 8.

The process cartridge 800 illustrated in FIG. 8 contains a photoconductor 801, a charging unit 802, a developing unit 803, and a cleaning unit 806.

The operation of this process cartridge 800 is explained. The photoconductor 801 is rotationally driven at a certain circumferential speed. During the rotation of the photoconductor 801, a circumferential surface of the photoconductor 801 is uniformly charged positively or negatively at the predetermined potential by the charging unit 802. Next, imagewise light is applied from an image exposing unit, which is not illustrated, such as slit exposure and laser beam scanning exposure. In this manner latent electrostatic images are sequentially formed on the circumferential surface of the photoconductor 801. The formed latent electrostatic image is then visualized with a toner by means of the developing unit 803 to form a toner image. The developed toner images are substantially transferred by a transferring unit, which is not illustrated, onto a recording medium, synchronized to the rotation of the photoconductor 801 and fed from a paper feeding part to between the photoconductor 801 and the transferring unit. The recording medium on which the image have been transferred is separated from the surface of the photoconductor, and guided to an image fixing unit, which is not illustrated, to thereby fix the image. Then the resultant is discharged as a printed out copy. The surface of the photoconductor 801 after the image transfer is cleaned by the cleaning unit 806 to remove the residual toner thereon, and diselectrified. Thereafter, the photoconductor 801 is used again for image formation.

EXAMPLES

Examples of the present invention will be explained hereinafter, but these examples shall not be construed to limit the scope of the present invention.

Production Example 1

<Production of Toner Base Particles 1>

—Synthesis of Crystalline Polyester Resin—

A 5 L four-necked flask equipped with a nitrogen-introducing pipe, a condenser, a stirrer, and a thermocouple was charged with 2,300 g of 1,10-decanedioic acid, 2,530 g of 1,8-octanediol, and 4.9 g of hydroquinone, and the mixture was allowed to react for 8 hours at 180° C., then the resultant was heated to 215° C. to react for 3 hours, followed by further reacting for 2 hours at 8.3 kPa to thereby synthesize Crystalline Polyester Resin 1.

Crystalline Polyester Resin 1 had the DSC peak temperature of 70° C., and the weight average molecular weight Mw of 13,000 and the number average molecular weight Mn of 3,200, where Mw and Mn were measured by GPC. Moreover, the ratio Mw/Mn was 3.5.

—Synthesis of Non-Crystalline Polyester (Unmodified Polyester) Resin 1—

A 5 L four necked flask equipped with a nitrogen-introducing pipe, a condenser, a stirrer, and a thermocouple was charged with 229 parts by mass of a bisphenol A ethylene oxide (2 mol) adduct, 529 parts by mass of a bisphenol A propylene oxide (3 mol) adduct, 100 parts by mass of isophthalic acid, 108 parts by mass of terephthalic acid, 46 parts by mass of adipic acid, and 2 parts by mass of dibutyl tin oxide. The resulting mixture was allowed to react for 8 hours at 220° C. under ambient pressure, followed by reacting for 5 hours under the reduced pressure of 10 mmHg to 15 mmHg. Then, 30 parts by mass of trimellitic anhydride was added to the reaction vessel, the resulting mixture was allowed to react for 3 hours at 180° C. under ambient pressure, to thereby synthesize Non-Crystalline Polyester Resin 1.

Non-Crystalline Polyester Resin 1 had the number average molecular weight of 1,600, the weight average molecular weight of 4,800, the glass transition temperature (Tg) of 55° C., and the acid value of 17 mgKOH/g.

—Synthesis of Prepolymer—

A reaction vessel equipped with a cooling tube, a stirrer, and a nitrogen-introducing pipe was charged with 682 parts by mass of a bisphenol A ethylene oxide (2 mol) adduct, 81 parts by mass of a bisphenol A propylene oxide (2 mol) adduct, 283 parts of terephthalic acid, 22 parts by mass of trimellitic anhydride, and 2 parts by mass of dibutyl tin oxide, and the resulting mixture was allowed to react for 8 hours at 230° C. under ambient pressure, and the further reacted for 5 hours under the reduced pressure of 10 mmHg to 15 mmHg, to thereby obtain Intermediate Polyester Resin 1.

Intermediate Polyester Resin 1 had the number average molecular weight of 2,100, the weight average molecular weight of 9,500, the glass transition temperature (Tg) of 55° C., the acid value of 0.5 mgKOH/g, and the hydroxyl value of 51 mgKOH/g.

A reaction vessel equipped with a cooling tube, a stirrer, and a nitrogen-introducing pipe was charged with 410 parts by mass of Intermediate Polyester Resin 1, 89 parts by mass of isophorone diisocyanate, and 500 parts by mass of ethyl acetate, and the mixture was allowed to react for 5 hours at 100° C. to thereby obtain Prepolymer 1. Prepolymer 1 had the isocyanate libration rate (% by mass) of 1.53%.

—Synthesis of Ketimine—

A reaction vessel equipped with a stirring rod, and a thermometer was charged with 170 parts by mass of isophorone diamine and 75 parts by mass of methyl ethyl ketone, and the mixture was allowed to react for 5 hours at 50° C. to thereby obtain Ketimine Compound 1. Ketimine Compound 1 had the amine value of 418.

—Preparation of Master Batch (MB)—

Water (1,200 parts by mass), 540 parts by mass of C.I.Pigment Blue 15:3 (manufactured by Dainichiseika Color & Chemicals Mfg. Co., Ltd.), and 1,200 parts by mass of Non-Crystalline Polyester Resin 1 were mixed together with HENSCHEL MIXER (manufactured by Mitsui Mining Co., Ltd.). The resulting mixture was kneaded for 30 minutes at 80° C. with a two-roll kneader, and then was rolled and cooled, followed by pulverized with a pulverizer, to thereby obtain Master Batch Cy.

—Preparation of Oil Phase—

A vessel equipped with a stirring rod and a thermometer was charged with 378 parts by mass of Non-Crystalline Polyester Resin 1, 110 parts by mass of paraffin wax (HNP-51, manufactured by NIPPON SEIRO CO., LTD.) as a releasing agent, 22 parts by mass of a charging agent (CCA, salicylic acid metal complex E-84, manufactured by Orient Chemical Industries, Ltd.), and 947 parts by mass of ethyl acetate. The resulting mixture was heated to 80° C. with stirring, and the temperature was kept at 80° C. for 5 hours, followed by cooling to 30° C. over 1 hour.

Next, a vessel was charged with 500 parts by mass of Master Batch Cy, and 500 parts by mass of ethyl acetate, and the mixture was mixed for 1 hour to thereby obtain Raw Material Solution 1.

Raw Material Solution 1 (1,324 parts by mass) was transferred to a vessel, and the pigment and the wax therein were dispersed by means of a bead mill (ULTRA VISCOMILL, manufactured by AIMEX CO., Ltd.) under the conditions: a liquid feed rate of 1 kg/hr, disc circumferential velocity of 6 m/s, 0.5 mm-zirconia beads packed to 80% by volume, and 3 passes.

To the resultant, 1,042.3 parts by mass of a 65% by mass Non-Crystalline Polyester Resin 1 ethyl acetate solution was added, and the resultant was dispersed by the bead mill once under the conditions described above, to thereby obtain Pigment-Wax Dispersion Liquid 1. Pigment-Wax Dispersion Liquid 1 had the solid content of 50% by mass.

—Preparation of Crystalline Polyester Dispersion Liquid—

A 2 L metal vessel was charged with 100 parts by mass of Crystalline Polyester Resin 1 and 400 parts by mass of ethyl acetate, and the resultant was heated to 75° C. to dissolve Crystalline Polyester Resin 1, and then the resulting solution was quenched in an ice-water bath at the rate of 27° C./min. To this, 500 mL of glass beads (diameter: 3 mm) was added, and the resultant was subjected to pulverization for 10 hours by means of a batch-type sand mill (manufactured by Kanpe Hapio Co., Ltd.) to thereby obtain Crystalline Polyester Dispersion Liquid 1.

—Synthesis of Organic Particle Emulsion—

A reaction vessel equipped with a stirring rod and a thermometer was charged with 683 parts by mass of water, 11 parts by mass of a sodium salt of sulfuric acid ester of methacrylic acid-ethylene oxide adduct (ELEMINOL RS-30, manufactured by Sanyo Chemical Industries, Ltd.), 138 parts by mass of styrene, 138 parts by mass of methacrylic acid, and 1 part by mass of ammonium persulfate, and the resulting mixture was stirred for 15 minutes at 400 rpm to thereby prepare a white emulsion. The obtained emulsion was heated until the internal system temperature reached 75° C., and then was allowed to react for 5 hours. To the resultant, 30 parts by mass of a 1% by mass ammonium persulfate aqueous solution was further added, and the resulting mixture was aged for 5 hours at 75° C., to thereby obtain an aqueous dispersion liquid of a vinyl resin (a copolymer of styrene/methacrylic acid/a sodium salt of sulfuric acid ester of methacrylic acid-ethylene oxide adduct), i.e. Particle Dispersion Liquid 1.

The volume average particle diameter of Particle Dispersion Liquid 1 as measured by a particle size distribution analyzer (LA-920, manufactured by HORIBA, Ltd.) was 0.14 μm. Part of Particle Dispersion Liquid 1 was dried to isolate the resin component.

—Preparation of Aqueous Phase—

Water (990 parts by mass), 83 parts by mass of Particle Dispersion Liquid 1, 37 parts by mass of a 48.5% by mass sodium dodecyldiphenyl ether disulfonate aqueous solution (ELEMINOL MON-7, product of Sanyo Chemical Industries Ltd.) and 90 parts by mass of ethyl acetate were mixed together and stirred to obtain an opaque white liquid, which was used as Aqueous Phase 1.

—Emulsification and Removal of Solvent—

A vessel was charged with 664 parts by mass of Pigment-Wax Dispersion Liquid 1, 109.4 parts by mass of Prepolymer 1, 73.9 parts by mass of Crystalline Polyester Dispersion Liquid 1, and 4.6 parts by mass of Ketimine Compound I, and the mixture was mixed for 1 minute at 5,000 rpm with a TK homomixer (manufactured by Tokushu Kika Kogyo Co., Ltd.), followed by further adding 1,200 parts by mass of Aqueous Phase 1 to the vessel. The resultant was mixed for 20 minutes at 13,000 rpm with the TK homomixer, to thereby obtain Emulsified Slurry 1.

Next, a vessel equipped with a stirrer and a thermometer was charged with Emulsified Slurry 1, and the solvent therein was removed at 30° C. for 8 hours, followed by performing aging for 4 hours at 45° C., to thereby obtain Dispersion Slurry 1.

—Washing and Drying—

After filtering 100 parts by mass of Dispersion Slurry 1, the following operations (1) to (4) were performed twice, to thereby obtain Filtration Cake 1.

(1): To the filtration cake, 100 parts by mass of ion-exchanged water was added, and the mixture was mixed (at 12,000 rpm for 10 minutes) by the TK homomixer, followed by filtering the mixture.

(2): To the filtration cake obtained in (1), 100 parts by mass of a 10% by mass sodium hydroxide aqueous solution was added, and the mixture was mixed (at 12,000 rpm for 30 minutes) by the TK homomixer, followed by filtering the mixture under the reduced pressure.

(3): To the filtration cake obtained in (2), 100 parts by mass of 10% by mass hydrochloric acid was added, and the mixture was mixed (at 12,000 rpm for 10 minutes) by the TK homomixer, followed by filtering the mixture.

4): To the filtration cake obtained in (3), 300 parts by mass of ion-exchanged water was added, and the mixture was mixed (at 12,000 rpm for 10 minutes) by the TK homomixer, followed by filtering the mixture.

Filtration Cake 1 was dried with an air-circulating drier for 48 hours at 45° C., and was then passed through a sieve with a mesh size of 75 μm, to thereby prepare Toner Base Particles 1.

Production Example 2

—Production of Toner Base Particles 2—

Toner Base Particles 2 were produced in the same manner as in Production Example 1, provided that, in the course of the production of Emulsified Slurry 1 in the emulsification and the removal of the solvent, "the mixing for 20 minutes at 13,000 rpm with the TK homomixer" was changed to "the mixing for 25 minutes at 11,000 rpm with the TK homomixer."

Production Example 3

—Production of Toner Base Particles 3—

Toner Base Particles 3 were produced in the same manner as in Production Example 1, provided that, in the course of the production of Emulsified Slurry 1 in the emulsification and the removal of the solvent, "the mixing for 20 minutes at 13,000 rpm with the TK homomixer" was changed to "the mixing for 10 minutes at 13,000 rpm with the TK homomixer."

Production Example 4

—Production of Toner Base Particles 4—

Toner Base Particles 4 were produced in the same manner as in Production Example 1, provided Crystalline Polyester Dispersion Liquid 1 was not used in the emulsification and the removal of the solvent.

Production Example 5

| Production of Toner Base Particles 5 | |
|---|---|
| Non-Crystalline Polyester Resin 1 | 75 parts by mass |
| Crystalline Polyester Resin 1 | 8 parts by mass |
| Master Batch Cy | 8 parts by mass |
| Charge controlling agent (BE-84, manufactured by Orient Chemical Industries, Ltd.) | 3 parts by mass |
| Paraffin wax (HNP-51, manufactured by NIPPON SEIRO CO., LTD.) | 4 parts by mass |

After mixing the materials listed above by means of HENSCHEL MIXER (HENSCHEL 20B, manufactured by Mitsui Mining Co., Ltd.), the resulting mixture was kneaded by a kneadex kneader whose surface temperature was set to 50° C. The kneaded product was then rolled and cooled, followed by roughly pulverized. Then, the resultant was subjected to pulverization with a jet mill type pulverizer (I-2 type mill, manufactured by Nippon Pneumatic Mfg. Co., Ltd.) and to air classification using a stewing flow (DS classifier, manufactured by Nippon Pneumatic Mfg. Co., Ltd.), to thereby produce Toner Base Particles 5.

Next, the volume average particle diameter Dv and average circularity of Toner Base Particles 1 to 5 were measured in the following manners. The results are presented in Table 1.

<Measurement of Volume Average Particle Diameter Dv of Toner Base Particles>

The measurement of the volume average particle diameter Dv of the toner base particles was performed by measuring a particle size distribution thereof by connecting Coulter Multisizer III with PC-9801 personal computer (manufactured by NEC) via an interface (manufactured by The Institute of Japanese Union of Scientists and Engineers) configured t output a number distribution and volume distribution.

Specifically, first, 0.1 mL to 5 mL of a surfactant (alkyl benzene sulfonate) was added as a dispersant to 100 mL to 150 mL of an electrolyte. Note that, the electrolyte was an about 1% by mass aqueous solution prepared by using a primary sodium chloride, and for example, ISOTON-II (of Beckman Coulter, Inc.) was used as the electrolyte.

Next, to the resulting mixture, 2 mg to 20 mg of a sample was added and suspended, and the mixture was dispersed by means of an ultrasonic wave disperser for about 1 minute to about 3 minutes. The volume and number of the toner were measured from the obtained dispersion liquid using the aforementioned measuring device with an aperture of 100 μm, and then the volume distribution and the number distribution of the toner were calculated.

Note that, as a channel, the following 13 channels were used: 2.00 μm or larger, but smaller than 2.52 μm: 2.52 μm or larger, but smaller than 3.17 μm; 3.17 μm or larger, but smaller than 4.00 μm: 4.00 μm or larger, but smaller than 5.04 μm; 5.04 μm or larger, but smaller than 6.35 μm; 6.35 μm or larger, but smaller than 8.00 μm; 8.00 μm or larger, but smaller than 10.08 μm; 10.08 μm or larger, but smaller than 12.70 μm; 12.70 μm or larger, but smaller than 16.00 μm; 16.00 μm or larger, but smaller than 20.20 μm; 20.20 μm or larger, but smaller than 25.40 μm; 25.40 μm or larger, but smaller than 32.00 μm; and 32.00 μm or larger, but smaller than 40.30 μm. The target particles for the measurement were particles having the diameters of 2.00 μm or larger, but smaller than 40.30 μm.

<Measurement of Average Circularity>

The average circularity of the toner was measured using a flow particle image analyzer (FPIA-2100, manufactured Sysmex Corporation), and the measurement results were analyzed using an analysis software (FPIA-2100 Data Processing Program for FPIA version 00-10).

First, a 100 mL glass beaker was charged with 0.1 mL to 0.5 mL of a 10% by mass surfactant (Neogen SC-A, manufactured by Dai-Ichi Kogyo Seiyaku Co., Ltd.), and 0.1 g to 0.5 g of each toner, and the mixture was stirred microspartel, followed by adding 80 mL of ion-exchanged water. The obtained dispersion liquid was dispersed for 3 minutes by means of an ultrasonic wave disperser (manufactured by Honda Electronics Co., Ltd.), and the resulting dispersion liquid having a concentration of 5,000 particles/μL to 15,000 particles/μL was subjected to measurement of the shape and distribution of the toner by means of FPIA-2100.

TABLE 1

| | Volume average particle diameter Dv | Average circularity | Note |
|---|---|---|---|
| Toner Base Particles 1 | 5.0 μm | 0.96 | |
| Toner Base Particles 2 | 5.0 μm | 0.94 | |
| Toner Base Particles 3 | 7.0 μm | 0.94 | |
| Toner Base Particles 4 | 5.0 μm | 0.96 | No crystallinity |
| Toner Base Particles 5 | 7.0 μm | 0.92 | |

Production Example 6

—Production of Fatty Acid Metal Salt Particles A—

The temperature of a 0.5% by mass sodium stearate aqueous solution was adjusted to 75° C. To the solution, a 0.5% by mass zinc sulfate aqueous solution was added little by little. After adding the entire portion of the zinc sulfate solution, the resulting mixture was mixed for 1 hour. After the mixing, the mixture was cooled to 20° C., and the fatty acid metal salt slurry as obtained was filtered and washed. The washed fatty acid metal salt cake was dried by means of a heating-type vacuum dryer (DP-23, manufactured by Yamato Scientific Co., Ltd.), followed by pulverized by means of a jet mill (Labo jet, manufactured by Nippon Pneumatic Mfg. Co., Ltd.). The resultant was then subjected to classification by means of Elbow-Jet classifier (EJ-L-3, manufactured by Nittetsu Mining Co., Ltd.), to thereby produce zinc stearate particles (Fatty Acid Metal Salt Particles A).

The volume average particle diameter Dv of the obtained zinc stearate particles (fatty acid metal salt particles A) was measured by a laser diffraction/scattering particle size distribution analyzer (LA-920, manufactured by HORIBA, Ltd.) and it was 5.3 μm.

Production Example 7

—Production of Fatty Acid Metal Salt Particles B—

Zinc stearate particles (Fatty Acid Metal Salt Particles B) were produced in the same manner as in Production Example 6, provided that after the drying, pulverization was performed by means of a Nan grinding mill (NJ-300, Sunrex-Kogyo Co., Ltd.), followed by obtaining re-slurry, and only fine particles were collected by means of a wet cyclone classifier (TR-5 Superclone, Murata Kogyo Co., Ltd.).

The volume average particle diameter Dv of the obtained zinc stearate particles (fatty acid metal salt particles B) was measured by a laser diffraction/scattering particle size distribution analyzer (LA-920, manufactured by HORIBA, Ltd.) and it was 0.98 μm.

Production Example 8

—Production of Fatty Acid Metal Salt Particles C—

Calcium stearate particles (Fatty Acid Metal Salt Particles C) were produced in the same manner as in Production Example 6, provided that the 0.5% by mass sodium stearate aqueous solution was replaced with a 0.8% by mass calcium chloride solution.

The volume average particle diameter Dv of the obtained calcium stearate particles (fatty acid metal salt particles C) was measured by a laser diffraction/scattering particle size distribution analyzer (LA-920, manufactured by HORIBA, Ltd.) and it was 6.5 μm.

Production Example 9

—Production of Fatty Acid Metal Salt Particles D—

Zinc stearate particles (Fatty Acid Metal Salt Particles D) were produced in the same manner as in Production Example 7, provided that the conditions of cyclone classification were changed.

The volume average particle diameter Dv of the obtained zinc stearate particles (fatty acid metal salt particles D) was measured by a laser diffraction/scattering particle size distribution analyzer (LA-920, manufactured by HORIBA, Ltd.) and it was 0.61 μm.

Example 1

| Production of Toner | |
|---|---|
| Toner Base Particles 1 | 100 parts by mass |
| Hydrophobic Silica Particles B (NX-90G, manufactured by Nippon Aerosil Co., Ltd., average primary particle diameter: 20 nm) | 1.0 part by mass |
| Hydrophobic Silica Particles A (RY-50, manufactured by Nippon Aerosil Co., Ltd., average primary particle diameter: 40 nm) | 1.0 part by mass |
| Titanium oxide particles (MT-150, manufactured by TAYCA CORPORATION, average primary particle diameter: 15 nm) | 0.5 parts by mass |

HENSCHEL MIXER (HENSCHEL 20B, manufactured by Mitsui Mining Co., Ltd.) was charged with the above-listed materials for a toner, and the mixture was mixed for 10 minutes at 3,000 rpm with the temperature of the raw material bed being kept in the range of 25° C. to 30° C. (mixing of the first stage). After the mixing, 0.15 parts by mass of Fatty Acid Metal Salt Particles A was added to the mixture, and the resulting mixture was subsequently mixed by means of HENSCHEL MIXER (HENSCHEL 20B, manufactured by Mitsui Mining Co., Ltd.) for 2 minutes at 2,500 rpm with the temperature of the raw material bed being kept in the range of 25° C. to 30° C. (mixing of the second stage). After the mixing, the resulting mixture was passed through a sieve having an opening size of 36 μm using an ultrasonic oscillator (TMS-50, manufactured by Tokuju Corporation), to thereby produce a toner of Example 1. Note that, the temperature of the raw material bed was the temperature of the powder in the mixer, which was confirmed by measuring the temperature of the material bed.

Examples 2 to 21 and Comparative Examples 1 to 5

Toners of Examples 2 to 21 and Comparative Examples 1 to 5 were each produced in the same manner as in Example 1, provided that HENSCHEL MIXER (HENSCHEL 20B, manufactured by Mitsui Mining Co., Ltd.) was charged with the toner base particles, inorganic particles, and fatty acid metal salt particles as depicted in Table 2 in amounts as depicted in Table 2, and the mixing was performed under the mixing conditions (rotation number, mixing time, and temperature of raw material bed) of the first stage and the second stage as depicted in Table 3.

Note that, in Example 20 Comparative Example 5, inorganic particles and fatty acid metal salt particles were mixed simultaneously in the first stage, and therefore the mixing was not performed in the second stage.

TABLE 2-1

| | Toner Base | Inorganic Particles | | | | | |
|---|---|---|---|---|---|---|---|
| | Particles No. | Type | Amount (mass parts) | Type | Amount (mass parts) | Type | Amount (mass parts) |
| Ex. 1 | 1 | Hydrophobic Silica A | 1.00 | Hydrophobic Silica B | 1.00 | titanium oxide | 0.5 |
| Ex. 2 | 1 | Hydrophobic Silica A | 1.00 | Hydrophobic Silica B | 1.00 | titanium oxide | 0.5 |
| Ex. 3 | 1 | Hydrophobic Silica A | 1.00 | Hydrophobic Silica B | 1.00 | titanium oxide | 0.5 |
| Ex. 4 | 1 | Hydrophobic Silica A | 1.00 | Hydrophobic Silica B | 1.00 | titanium oxide | 0.5 |
| Ex. 5 | 1 | Hydrophobic Silica A | 1.00 | Hydrophobic Silica B | 1.00 | titanium oxide | 0.5 |

TABLE 2-1-continued

| | Toner Base | Inorganic Particles | | | | | |
|---|---|---|---|---|---|---|---|
| | Particles No. | Type | Amount (mass parts) | Type | Amount (mass parts) | Type | Amount (mass parts) |
| Ex. 6 | 1 | Hydrophobic Silica A | 1.00 | Hydrophobic Silica B | 1.00 | titanium oxide | 0.5 |
| Ex. 7 | 1 | Hydrophobic Silica A | 1.00 | Hydrophobic Silica B | 1.00 | titanium oxide | 0.5 |
| Ex. 8 | 1 | Hydrophobic Silica B | 1.00 | Hydrophobic Silica C | 1.20 | titanium oxide | 0.5 |
| Ex. 9 | 1 | Hydrophobic Silica A | 0.50 | Hydrophobic Silica B | 0.75 | titanium oxide | 0.5 |
| Ex. 10 | 1 | Hydrophobic Silica A | 0.75 | Hydrophobic Silica C | 0.75 | titanium oxide | 0.5 |
| Ex. 11 | 1 | Hydrophobic Silica A | 1.00 | Hydrophobic Silica B | 1.00 | titanium oxide | 0.5 |
| Ex. 12 | 1 | Hydrophobic Silica A | 1.00 | Hydrophobic Silica B | 1.00 | titanium oxide | 0.5 |
| Ex. 13 | 1 | Hydrophobic Silica A | 1.00 | Hydrophobic Silica B | 1.00 | titanium oxide | 0.5 |
| Ex. 14 | 1 | Hydrophobic Silica A | 1.00 | Hydrophobic Silica B | 1.00 | titanium oxide | 0.5 |
| Ex. 15 | 2 | Hydrophobic Silica A | 1.00 | Hydrophobic Silica B | 1.00 | titanium oxide | 0.5 |
| Ex. 16 | 3 | Hydrophobic Silica A | 1.00 | Hydrophobic Silica B | 1.00 | titanium oxide | 0.5 |
| Ex. 17 | 5 | Hydrophobic Silica A | 1.00 | Hydrophobic Silica B | 1.00 | titanium oxide | 0.5 |
| Ex. 18 | 4 | Hydrophobic Silica A | 1.00 | Hydrophobic Silica B | 1.00 | titanium oxide | 0.5 |
| Ex. 19 | 1 | Hydrophobic Silica A | 1.00 | Hydrophobic Silica B | 1.00 | titanium oxide | 0.5 |
| Ex. 20 | 1 | Hydrophobic Silica A | 1.00 | Hydrophobic Silica B | 1.00 | titanium oxide | 0.5 |
| Ex. 21 | 1 | Hydrophobic Silica A | 0.50 | Hydrophobic Silica B | 0.60 | titanium oxide | 0.5 |
| Comp. Ex. 1 | 1 | Hydrophobic Silica A | 1.00 | Hydrophobic Silica B | 1.00 | titanium oxide | 0.5 |
| Comp. Ex. 2 | 1 | Hydrophobic Silica A | 1.00 | Hydrophobic Silica B | 1.00 | titanium oxide | 0.5 |
| Comp. Ex. 3 | 1 | Hydrophobic Silica A | 1.00 | Hydrophobic Silica B | 1.00 | titanium oxide | 0.5 |
| Comp. Ex. 4 | 1 | Hydrophobic Silica A | 1.00 | Hydrophobic Silica B | 1.00 | titanium oxide | 0.5 |
| Comp. Ex. 5 | 1 | Hydrophobic Silica A | 1.00 | Hydrophobic Silica B | 1.00 | titanium oxide | 0.5 |

Hydrophobic Silica A (RY-50, manufactured by Nippon Aerosil Co., Ltd., average primary particle diameter: 40 nm)
Hydrophobic Silica B (NX-90G, manufactured by Nippon Aerosil Co., Ltd., average primary particle diameter: 20 nm)
Hydrophobic Silica C (RY-200S, manufactured by Nippon Aerosil Co., Ltd., average primary particle diameter: 16 nm)
titanium oxide (MT-150, manufactured by TAYCA CORPORATION, average primary particle diameter: 15 nm)

TABLE 2-2

| | Covering rate (%) with inorganic particles | Fatty acid metal salt particles | | |
|---|---|---|---|---|
| | | type | amount (mass parts) | Volume average particle diameter (μm) |
| Ex. 1 | 70 | Fatty Acid Metal Salt Particles A | 0.15 | 5.3 |
| Ex. 2 | 70 | Fatty Acid Metal Salt Particles A | 0.15 | 5.3 |
| Ex. 3 | 70 | Fatty Acid Metal Salt Particles A | 0.15 | 5.3 |
| Ex. 4 | 70 | Fatty Acid Metal Salt Particles A | 0.15 | 5.3 |
| Ex. 5 | 70 | Fatty Acid Metal Salt Particles A | 0.15 | 5.3 |
| Ex. 6 | 70 | Fatty Acid Metal Salt Particles A | 0.15 | 5.3 |
| Ex. 7 | 70 | Fatty Acid Metal Salt Particles A | 0.15 | 5.3 |
| Ex. 8 | 96 | Fatty Acid Metal Salt Particles A | 0.15 | 5.3 |
| Ex. 9 | 51 | Fatty Acid Metal Salt Particles A | 0.15 | 5.3 |
| Ex. 10 | 60 | Fatty Acid Metal Salt Particles A | 0.15 | 5.3 |
| Ex. 11 | 70 | Fatty Acid Metal Salt Particles A | 0.40 | 5.3 |
| Ex. 12 | 70 | Fatty Acid Metal Salt Particles A | 0.03 | 5.3 |
| Ex. 13 | 70 | Fatty Acid Metal Salt Particles B | 0.15 | 0.98 |
| Ex. 14 | 70 | Fatty Acid Metal Salt Particles C | 0.15 | 6.5 |
| Ex. 15 | 70 | Fatty Acid Metal Salt Particles A | 0.15 | 5.3 |

TABLE 2-2-continued

| | Covering rate (%) with inorganic particles | Fatty acid metal salt particles type | amount (mass parts) | Volume average particle diameter (μm) |
|---|---|---|---|---|
| Ex. 16 | 70 | Fatty Acid Metal Salt Particles A | 0.15 | 5.3 |
| Ex. 17 | 70 | Fatty Acid Metal Salt Particles A | 0.15 | 5.3 |
| Ex. 18 | 70 | Fatty Acid Metal Salt Particles A | 0.15 | 5.3 |
| Ex. 19 | 70 | Fatty Acid Metal Salt Particles D | 0.15 | 0.61 |
| Ex. 20 | 70 | Fatty Acid Metal Salt A | 0.15 | 5.3 |
| Ex. 21 | 45 | Fatty Acid Metal Salt A | 0.15 | 5.3 |
| Comp. Ex. 1 | 70 | Fatty Acid Metal Salt Particles A | 0.15 | 5.3 |
| Comp. Ex. 2 | 70 | Fatty Acid Metal Salt Particles A | 0.15 | 5.3 |
| Comp. Ex. 3 | 70 | Fatty Acid Metal Salt Particles A | 0.15 | 5.3 |
| Comp. Ex. 4 | 70 | Fatty Acid Metal Salt Particles A | 0.15 | 5.3 |
| Comp. Ex. 5 | 70 | Fatty Acid Metal Salt Particles D | 1.15 | 0.61 |

*Fatty Acid Metal Salt Particles A to D were those produced in Production Examples 6 to 9.

TABLE 3-1

| | Mixing in 1st stage Type | Rotation number | Mixing time (min) | Temperature of raw material bed (° C.) |
|---|---|---|---|---|
| Ex. 1 | inorganic particles | 3,000 | 10 | 25-30 |
| Ex. 2 | inorganic particles | 3,000 | 10 | 25-30 |
| Ex. 3 | inorganic particles | 3,000 | 7 | 25-30 |
| Ex. 4 | inorganic particles | 3,500 | 10 | 30-35 |
| Ex. 5 | inorganic particles | 3,000 | 5 | 25-30 |
| Ex. 6 | inorganic particles | 3,000 | 10 | 25-30 |
| Ex. 7 | inorganic particles | 3,000 | 10 | 25-30 |
| Ex. 8 | inorganic particles | 3,000 | 10 | 25-30 |
| Ex. 9 | inorganic particles | 3,000 | 10 | 25-30 |
| Ex. 10 | inorganic particles | 3,000 | 10 | 25-30 |
| Ex. 11 | inorganic particles | 3,000 | 10 | 25-30 |
| Ex. 12 | inorganic particles | 3,000 | 10 | 25-30 |
| Ex. 13 | inorganic particles | 3,000 | 10 | 25-30 |
| Ex. 14 | inorganic particles | 3,000 | 10 | 25-30 |
| Ex. 15 | inorganic particles | 3,000 | 10 | 25-30 |
| Ex. 16 | inorganic particles | 3,000 | 10 | 25-30 |
| Ex. 17 | inorganic particles | 3,000 | 10 | 25-30 |
| Ex. 18 | inorganic particles | 3,000 | 10 | 25-30 |
| Ex. 19 | inorganic particles | 3,000 | 10 | 25-30 |
| Ex. 20 | inorganic particles + fatty acid metal salt | 3,000 | 10 | 25-30 |
| Ex. 21 | inorganic particles | 3,000 | 10 | 25-30 |
| Comp. Ex. 1 | fatty acid metal salt | 3,000 | 3 | 25-30 |
| Comp. Ex. 2 | inorganic particles | 3,000 | 10 | 25-30 |
| Comp. Ex. 3 | inorganic particles | 3,500 | 10 | 30-35 |
| Comp. Ex. 4 | inorganic particles | 2,500 | 2 | 25-30 |
| Comp. Ex. 5 | inorganic particles + fatty acid metal salt | 3,000 | 10 | 25-30 |

TABLE 3-2

| | Mixing in 2nd stage Type | Rotation number | Mixing time (min) | Temperature of raw material bed (° C.) |
|---|---|---|---|---|
| Ex. 1 | fatty acid metal salt | 2,500 | 2 | 25-30 |
| Ex. 2 | fatty acid metal salt | 2,500 | 1 | 25-30 |

TABLE 3-2-continued

| | Mixing in 2nd stage Type | Rotation number | Mixing time (min) | Temperature of raw material bed (° C.) |
|---|---|---|---|---|
| Ex. 3 | fatty acid metal salt | 2,500 | 2 | 25-30 |
| Ex. 4 | fatty acid metal salt | 2,500 | 2 | 25-30 |
| Ex. 5 | fatty acid metal salt | 2,500 | 2 | 25-30 |
| Ex. 6 | fatty acid metal salt | 2,500 | 2 | 30-35 |
| Ex. 7 | fatty acid metal salt | 2,500 | 5 | 25-30 |
| Ex. 8 | fatty acid metal salt | 2,500 | 2 | 25-30 |
| Ex. 9 | fatty acid metal salt | 2,500 | 2 | 25-30 |
| Ex. 10 | fatty acid metal salt | 2,500 | 2 | 25-30 |
| Ex. 11 | fatty acid metal salt | 2,500 | 2 | 25-30 |
| Ex. 12 | fatty acid metal salt | 2,500 | 2 | 25-30 |
| Ex. 13 | fatty acid metal salt | 2,500 | 2 | 25-30 |
| Ex. 14 | fatty acid metal salt | 2,500 | 2 | 25-30 |
| Ex. 15 | fatty acid metal salt | 2,500 | 2 | 25-30 |
| Ex. 16 | fatty acid metal salt | 2,500 | 2 | 25-30 |
| Ex. 17 | fatty acid metal salt | 2,500 | 2 | 25-30 |
| Ex. 18 | fatty acid metal salt | 2,500 | 2 | 25-30 |
| Ex. 19 | fatty acid metal salt | 2,500 | 2 | 25-30 |
| Ex. 20 | — | — | — | — |
| Ex. 21 | fatty acid metal salt | 2,500 | 2 | 25-33 |
| Comp. Ex. 1 | inorganic particles | 3,000 | 10 | 25-30 |
| Comp. Ex. 2 | fatty acid metal salt | 1,000 | 0.5 | 25-30 |
| Comp. Ex. 3 | fatty acid metal salt | 2,500 | 2 | 25-30 |
| Comp. Ex. 4 | fatty acid metal salt | 2,500 | 3 | 25-30 |
| Comp. Ex. 5 | — | — | — | — |

*In Example 20 and Comparative Example 5, the inorganic particles and the fatty acid metal salt were mixed simultaneously (mixing only in the first stage).

<Calculating Method of Covering Ratio with External Additive>

The covering rate of the toner base particles with the external additive (inorganic particles) was calculated by the following equation.

$$H=\Sigma(\sqrt{3}\times Dv\times Pt/(2\pi\cdot da\cdot Pa)\times Ca\times 100)$$

In the equation above, Dv represents the volume average particle diameter of the toner base particles, Pt represents the true specific gravity of the toner base particles, da represents the average particle diameter of the external additive, Pa represents the true specific gravity of the external additive, and Ca represents an amount (%) of the external additive contained in the toner.

Note that, in the case where the external additive was composed of a few types of external additives, the average primary particle diameter da, true specific gravity Pa, and amount Ca of each external additive were determined to calculate the covering rate with each external additive. The thus obtained covering rates were summed up to determined a total covering rate.

<<Average Primary Particle Diameter of External Additive>>

The measurement of the average primary particle diameter of the external additive was performed by dispersing primary particles in a solvent (tetrahydrofuran (THF)) followed by removing the solvent on a substrate to dry and prepare a sample; and measuring the average value of particle diameters of the external additive (the number of the particles measured: 100 particles) in the visual field as observed under a field emission scanning electron microscope (FE-SEM, accelerating voltage: 5 kV to 8 kV, magnification: ×8,000 to ×10,000).

<<Volume Average Particle Diameter of Toner Base Particles>>

The volume average particle diameter of the toner base particles was measured in the same manner as in the measurement of the volume average particle diameter of the toner.

<<True Specific Gravity>>

The true specific gravity of the toner base particles and that of the external additive were measured in accordance with 5-2-1 of JIS-K-0061:92 using le chatelier flask.

Specifically, the measurement was performed in the following order.

(1) Le chatelier flask was charged with about 250 mL of ethyl alcohol, and it was adjusted so that the meniscus thereof came to the position of the scale.
(2) The flask was immersed in a constant-temperature water bath, and when the liquid temperature reached at 20.0° C.±0.2° C., the position of the meniscus was accurately read with the scale of the flask (a degree of precision was ±0.025 mL).
(3) About 100.000 g of the sample was weight, and a mass thereof was determined as W.
(4) The collected sample was placed in the flask, and the bubbles were removed.
(5) The flask was immersed in the constant-temperature water bath, and when the liquid temperature reached at 20.0° C.±0.2° C., the position of the meniscus was accurately read with the scale of the flask (a degree of precision was ±0.025 mL).

After performing the operations of (1) to (5), the true specific gravity was calculated based on the following formulae (1) and (2).

$$D=W/(L2-L1) \quad \text{Formula (1):}$$

$$S=D/0.9982 \quad \text{Formula (2):}$$

Note that, in the formulae (1) and (2), D is a density (20° C.)(g/cm$^3$) of the sample, S is a specific gravity (20° C.) of the sample, W is an apparent mass (g) of the sample, L1 is the read value (mL) of the meniscus with the liquid temperature of 20° C. before adding the sample into the flask, L2 is the read value (20° C.)(mL) of the meniscus with the liquid temperature of 20° C. after adding the sample into the flask, and the constant "0.9982" in the formula (2) is the density (g/cm$^3$) of water at 20° C.

<Measuring Method of Liberation Ratio of External Additive>

The libration ratio of the external additive (hydrophobic silica particles, fatty acid metal salt particles) was measured in the following manner.

(1) A 200 mL-ointment bottle was charged with 100 mL of ion-exchanged water, and 4.4 mL of a 33% by mass DRIWEL aqueous solution (product name: DRIWEL, of FUJIFILM Corporation), which contained a surfactant. To the resulting mixture, 5 g of the toner was added, and the mixture was shaken 30 times by hand to sufficiently mix, followed by leaving to stand for 1 hour or longer.
(2) Next, after stirring by shaking 20 times by hand, the resultant was subjected to dispersion by applying ultrasonic wave energy for 2 minutes under the following conditions, by means of a ultrasonic homogenizer (product name: Homogenizer, type VCX750, CV33, Sonics & Materials, Inc.) with setting the dial to output 50%.

—Conditions of Ultrasonic Waves— vibration time: continuous 60 seconds
amplitude: 20 W (30%)
vibration onset temperature: 23° C.±1.5° C.

(3) The obtained dispersion liquid was subjected to vacuum filtration using filter paper (product name: Qualitative filter paper (No. 2, 110 mm), of Advantec Tokyo Roshi Kaisha, Ltd.), the resultant was washed twice with ion-exchanged water, and again filtered to remove the librated external additive, followed by drying the toner.
(4) The amount of the external additive contained in the toner before and after the removal of the external additive was determined by a fluorescent X-ray method (ZSX-100e, of Rigaku Corporation), to thereby obtain the libration rate of the external additive.

In the fluorescent X-ray method, the libration amount of the hydrophobic silica particles was measured by Si, and the libration amount of the fatty acid metal salt particles was measured by the corresponding metal (zinc, calcium).

From the values of the external additive amounts contained in the toner before and after the dispersion measured by the method containing (1) to (4), the libration ratio (% by mass) of the external additive were obtained using the following equation 1.

$$\text{Liberation ratio}=[(\text{external additive amount before dispersion}-\text{residual external additive amount after dispersion})/\text{external additive amount before dispersion}]\times 100 \quad \text{[Equation 1]}$$

<Image Formation>

Image formation was performed by means of a modified device of an image forming apparatus (Ricoh Pro C751ex, manufactured by Ricoh Company Limited), in which a contact charging unit, process linear velocity, and a developing gap of a developing unit thereof could be changeable, under the following conditions. Note that, unless otherwise stated, the process linear velocity was 500 mm/s, the charging unit was a contact charging unit, and the developing gap of the developing unit was 0.3 mm.

An image having an imaging area of 5% and an image having an imaging area of 20% were alternately output per 1,000 sheets, under the conditions of 23° C. and 50% RH (during the printing of 0 or more but less than 10,000 sheets), 28° C. and 85% RH (during the printing of 10,000 sheets or more but less than 20,000 sheets), and 15° C. and 30% RH (during the printing of 20,000 sheets or more but less than 30,000). Three sets of the aforementioned image formation by the device were performed until 90,000 sheets were output.

<Evaluation of Low Temperature Fixing Ability>

A dot image and a solid image were alternately output per 10,000 sheets, and the presence of peeled image, and the residual rate of the image density before or after scraping the solid image with a pad were determined, to thereby evaluate the low temperature fixing ability of the toner based on the following criteria. Note that, the measurement of the image density was performed by means of X-Rite 938 (X-RITE).

[Evaluation Criteria]

A: There was no pealing of the image, and the residual rate of the image density was 85% or higher.

B: There was no pealing of the image, and the residual rate of the image density was 70% or higher but lower than 85%

C: There was pealing of the image, and the residual rate of the image density was lower than 70%.

<Evaluation of Toner Scattering>

After completing the image formation on the 90,000 sheets, a cover of the image forming apparatus was open to visually observe the toner smear inside the image forming apparatus, which was evaluated based on the following criteria.

[Evaluation Criteria]

A: No significant toner smear occurred.

B: A toner smear occurred, but there was no toner smear observed on the outer side of the cover.

C: A toner smear was observed also on the outer side of the cover, and scattering of the toner clearly occurred within the image forming apparatus.

<Scraping of Photoconductor and Photoconductor Contamination>

After completing the image formation on the 90,000 sheets, the photoconductor was observed, and formation of defected image in the dot image was confirmed, and the results were evaluated based on the following criteria.

The photoconductor scraping (or scraping of the photoconductor) means that scratches were formed on the photoconductor by the toner or the like, and in the severe case, the photoconductor is scraped along the circumferential direction.

[Evaluation Criteria]

A: There was no scraping of the photoconductor.

B: The photoconductor scraping occurred, but no difference was confirmed in the dot image.

C: The scratches were formed on the photoconductor, and a difference was significantly confirmed in the dot image.

<Evaluation of Deposition to Photoconductor>

After completing the image formation on the 90,000 sheets, the photoconductor was observed, and formation of defected image in the solid image was confirmed, and the results were evaluated based on the following criteria.

The deposition to the photoconductor means the state that developing cannot be carried out because the toner is deposited on the photoconductor by the pressure from the cleaning blade or the like.

[Evaluation Criteria]

A: There was no deposition to the photoconductor.

B: There was a slight deposition on the photoconductor, but a white missing part was not observed in the solid image.

C: There was the deposition on the photoconductor, and there was white missing area in the solid image.

<Evaluation of Toner Deposition>

After completing the image formation on the 90,000 sheets, the state of the toner deposition on mainly the areas in the toner transporting unit and a developing unit, where the friction were large (screw of the transporting unit and the axial part of the developing unit) was observed and also the image was observed. If the toner deposition occurred on these area and the toner was transported, the aggregation of the toner was formed in the image. The toner deposition was evaluated based on the following criteria.

[Evaluation Criteria]

A: No toner deposition was occurred.

B: A slight toner deposition was observed in the friction area, which was no problematic for the image.

C: The toner deposition was occurred in the friction area, and the aggregation of the toner was detected in the image.

<Comprehensive Evaluation>

As a comprehensive evaluation, a case where all items were evaluated as A was judged as I, a case where there was one or more Bs but there was no problem on practical use was judged as II, and a case where there was one or more Cs was judged as III.

TABLE 4-1

| | Liberation ratio Ya of hydrophobic silica particles (mass %) | Libration ratio Yb of fatty acid metal salt particles (mass %) | Covering rate (%) with inorganic particles | Dv of toner (μm) | Average circularity of toner |
|---|---|---|---|---|---|
| Ex. 1 | 4.5 | 55 | 70 | 5.0 | 0.96 |
| Ex. 2 | 4.5 | 75 | 70 | 5.0 | 0.96 |
| Ex. 3 | 8.8 | 55 | 70 | 5.0 | 0.96 |
| Ex. 4 | 1.5 | 55 | 70 | 5.0 | 0.96 |
| Ex. 5 | 12.0 | 55 | 70 | 5.0 | 0.96 |
| Ex. 6 | 4.5 | 42 | 70 | 5.0 | 0.96 |
| Ex. 7 | 3.5 | 43 | 70 | 5.0 | 0.96 |
| Ex. 8 | 4.5 | 55 | 96 | 5.0 | 0.96 |
| Ex. 9 | 4.5 | 55 | 51 | 5.0 | 0.96 |
| Ex. 10 | 5.2 | 52 | 60 | 5.0 | 0.96 |
| Ex. 11 | 4.5 | 55 | 70 | 5.0 | 0.96 |
| Ex. 12 | 4.5 | 55 | 70 | 5.0 | 0.96 |
| Ex. 13 | 4.5 | 55 | 70 | 5.0 | 0.96 |
| Ex. 14 | 4.5 | 55 | 70 | 5.0 | 0.96 |
| Ex. 15 | 4.5 | 55 | 70 | 5.0 | 0.94 |
| Ex. 16 | 4.5 | 55 | 70 | 7.0 | 0.96 |
| Ex. 17 | 4.5 | 55 | 70 | 7.0 | 0.92 |
| Ex. 18 | 4.5 | 55 | 70 | 5.0 | 0.96 |
| Ex. 19 | 4.5 | 48 | 70 | 5.0 | 0.96 |
| Ex. 20 | 4.2 | 32 | 70 | 5.0 | 0.96 |
| Ex. 21 | 4.0 | 55 | 45 | 5.0 | 0.96 |
| Comp. Ex. 1 | 4.5 | 27 | 70 | 5.0 | 0.96 |
| Comp. Ex. 2 | 4.5 | 95 | 70 | 5.0 | 0.96 |
| Comp. Ex. 3 | 0.8 | 55 | 70 | 5.0 | 0.96 |
| Comp. Ex. 4 | 22.0 | 47 | 70 | 5.0 | 0.96 |
| Comp. Ex. 5 | 4.5 | 20 | 70 | 5.0 | 0.96 |

TABLE 4-2

| | Minimum fixing | Toner scattering | Photoconductor scraping | Photoconductor contamination | Toner deposition | Comprehensive evaluation |
|---|---|---|---|---|---|---|
| Ex. 1 | A | A | A | A | A | I |
| Ex. 2 | A | A | A | A | A | I |
| Ex. 3 | A | A | A | A | A | I |
| Ex. 4 | A | A | A | A | A | I |
| Ex. 5 | A | A | B | B | A | II |
| Ex. 6 | A | B | A | A | A | II |
| Ex. 7 | A | B | A | A | A | II |
| Ex. 8 | A | A | A | B | A | II |
| Ex. 9 | A | A | A | A | B | II |
| Ex. 10 | A | A | A | A | A | I |
| Ex. 11 | A | B | A | A | A | II |
| Ex. 12 | A | A | A | B | B | II |
| Ex. 13 | A | A | A | A | B | II |
| Ex. 14 | A | A | A | A | B | II |
| Ex. 15 | A | A | A | A | A | I |
| Ex. 16 | A | A | A | A | A | I |

TABLE 4-2-continued

| | Minimum fixing | Toner scattering | Photoconductor scraping | Photoconductor contamination | Toner deposition | Comprehensive evaluation |
|---|---|---|---|---|---|---|
| Ex. 17 | A | B | A | A | A | II |
| Ex. 18 | B | A | A | A | A | II |
| Ex. 19 | A | A | B | B | B | II |
| Ex. 20 | A | B | A | B | A | II |
| Ex. 21 | A | A | A | A | B | II |
| Comp. Ex. 1 | A | C | A | B | B | III |
| Comp. Ex. 2 | A | A | A | A | C | III |
| Comp. Ex. 3 | A | A | C | A | A | III |
| Comp. Ex. 4 | A | A | A | C | A | III |
| Comp. Ex. 5 | A | C | B | B | C | III |

Note that, Example 1 was again performed with alternating (1) the process linear velocity to 900 mm/s, and (2) the developing gap to 0.5 mm, and as a result, excellent results similar to those of Example 1 were obtained.

The embodiments of the present invention are as follows:

<1> A toner, containing:

toner base particles each containing a binder resin and a colorant; and an external additive containing inorganic particles and fatty acid metal salt particles, wherein the inorganic particles contain at least hydrophobic silica particles, wherein a liberation ratio Ya of the hydrophobic silica particles from the toner is 1% by mass to 20% by mass, and wherein a libration ratio Yb of the fatty acid metal salt particles from the toner is 30% by mass to 90% by mass.

<2> The toner according to <1>, wherein the libration ratio Ya of the hydrophobic silica particles is 2% by mass to 10% by mass, and the libration ratio Yb of the fatty acid metal salt particles is 45% by mass to 70% by mass.

<3> The toner according to any of <1> or <2>, wherein a covering ratio of the toner base particle with the inorganic particles is 50% to 85%.

<4> The toner according to any one of <1> to <3>, wherein the fatty acid metal salt particles have the volume average particle diameter of greater than 0.65 μm but 10 μm or smaller.

<5> The toner according to any one of <1> to <4>, wherein an amount of the fatty acid metal salt particles is 0.05 parts by mass to 0.4 parts by mass, relative to 100 parts by mass of the toner base particles.

<6> The toner according to any one of <1> to <5>, wherein the fatty acid metal salt particles are zinc stearate particles.

<7> The toner according to any one of <1> to <6>, wherein the toner is obtained by externally adding the inorganic particles to the toner base particles, followed by externally adding the fatty acid metal salt particles to the toner base particles.

<8> The toner according to any one of <1> to <7>, wherein the binder resin contains a non-crystalline resin and a crystalline resin.

<9> The toner according to any one of <1> to <8>, wherein the toner base particles are obtained by the method containing:

dissolving or dispersing the binder resin, an active hydrogen group-containing compound, a binder resin precursor having a site reactive with the active hydrogen group-containing compound, a colorant, and a releasing agent in an organic solvent to prepare a solution or a dispersion liquid;

emulsifying the solution or the dispersion liquid in an aqueous medium to prepare an emulsion;

allowing the binder resin precursor and the active hydrogen group-containing compound to react in the emulsion; and removing the organic solvent.

<10> An image forming apparatus, containing:

a latent electrostatic image bearing member;

a charging unit configured to charge a surface of the latent electrostatic image bearing member;

an exposing unit configured to expose the charged latent electrostatic image bearing member to light to form a latent electrostatic image thereon;

a developing unit configured to develop the latent electrostatic image with a toner to form a visible image;

a transferring unit configured to transfer the visible image to a recording medium;

a fixing unit configured to fix the transferred visible image onto the recording medium; and a cleaning unit configured to clean the toner remained on the latent electrostatic image bearing member, wherein the toner is the toner according to any one of <1> to <9>.

This application claims priority to Japanese application No. 2012-016688, filed on Jan. 30, 2012, and incorporated herein by reference.

What is claimed is:

1. A toner, comprising:

toner base particles each comprising a binder resin and a colorant; and an external additive comprising inorganic particles and fatty acid metal salt particles, wherein the inorganic particles comprise at least hydrophobic silica particles, wherein a liberation ratio Ya of the hydrophobic silica particles from the toner is 1% by mass to 20% by mass, and wherein a libration ratio Yb of the fatty acid metal salt particles from the toner is 30% by mass to 90% by mass.

2. The toner according to claim 1, wherein the libration ratio Ya of the hydrophobic silica particles is 2% by mass to 10% by mass, and the libration ratio Yb of the fatty acid metal salt particles is 45% by mass to 70% by mass.

3. The toner according to claim 1, wherein a covering ratio of the toner base particle with the inorganic particles is 50% to 85%.

4. The toner according to claim 1, wherein the fatty acid metal salt particles have the volume average particle diameter of greater than 0.65 μm but 10 μm or smaller.

5. The toner according to claim 1, wherein an amount of the fatty acid metal salt particles is 0.05 parts by mass to 0.4 parts by mass, relative to 100 parts by mass of the toner base particles.

6. The toner according to claim 1, wherein the fatty acid metal salt particles are zinc stearate particles.

7. The toner according to claim 1, wherein the toner is obtained by externally adding the inorganic particles to the toner base particles, followed by externally adding the fatty acid metal salt particles to the toner base particles.

8. The toner according to claim 1, wherein the binder resin comprises a non-crystalline resin and a crystalline resin.

9. The toner according to claim 1, wherein the toner base particles are obtained by a method comprising:

dissolving or dispersing the binder resin, an active hydrogen group-containing compound, a binder resin precursor having a site reactive with the active hydrogen group-containing compound, a colorant, and a releasing agent in an organic solvent to prepare a solution or a dispersion liquid;

emulsifying the solution or the dispersion liquid in an aqueous medium to prepare an emulsion;

allowing the binder resin precursor and the active hydrogen group-containing compound to react in the emulsion; and removing the organic solvent.

* * * * *